US012539447B1

(12) United States Patent
Meckenzie et al.

(10) Patent No.: US 12,539,447 B1
(45) Date of Patent: Feb. 3, 2026

(54) SYSTEMS AND METHODS FOR IMPLEMENTING GUIDED EXERCISE ROUTINES

(71) Applicant: AMP FIT ISRAEL LTD, Tel Aviv (IL)

(72) Inventors: Shalom Meckenzie, Savyon (IL); Amir Levanon, Nir Banim (IL)

(73) Assignee: AMP FIT ISRAEL LTD, Tel Aviv (IL)

( * ) Notice: Subject to any disclaimer, the term of this patent is extended or adjusted under 35 U.S.C. 154(b) by 0 days.

(21) Appl. No.: 19/285,421

(22) Filed: Jul. 30, 2025

Related U.S. Application Data

(60) Provisional application No. 63/677,660, filed on Jul. 31, 2024.

(51) Int. Cl.
*A63B 24/00* (2006.01)
*A63B 21/00* (2006.01)
*A63B 21/005* (2006.01)

(52) U.S. Cl.
CPC ..... *A63B 24/0087* (2013.01); *A63B 21/0058* (2013.01); *A63B 21/151* (2013.01); *A63B 24/0062* (2013.01); *A63B 2024/0065* (2013.01); *A63B 2024/0093* (2013.01)

(58) Field of Classification Search
CPC ..... A63B 24/0087; A63B 21/0058; A63B 21/151; A63B 24/0062; A63B 2024/0065; A63B 2024/0093
See application file for complete search history.

(56) References Cited

U.S. PATENT DOCUMENTS 4,930,770 A * 6/1990 Baker ..... A63B 21/0058 482/141
5,304,104 A * 4/1994 Chi ..... A63B 21/153 482/99
5,597,373 A * 1/1997 Bond ..... A63B 21/0058 482/901
5,697,869 A * 12/1997 Ehrenfried ..... A63B 21/157 482/7

(Continued)

*Primary Examiner* — Garrett K Atkinson
(74) *Attorney, Agent, or Firm* — FINNEGAN, HENDERSON, FARABOW, GARRETT & DUNNER L.L.P.

(57) ABSTRACT

Systems, methods, and non-transitory computer readable medium are disclosed for controlling an electronic exercise machine. Controlling an electronic exercise machine includes: receiving a prompt to initiate a varying weight routine; retrieving information about a user to determine an initial resistance; displaying a progress indicator depicting the initial resistance; adjusting power to the exercise machine to exert an initial resistance; as the user exerts forces countering the initial resistance, monitoring a plurality of repetitions; updating the display to reflect repetition completions; when motion stoppage exceeds a time threshold: activating an additional indicator depicting a reduced resistance; altering power to the exercise machine to reduce the resistance; as the user exerts forces, monitoring a plurality of repetitions; updating the display to reflect reduced repetition completions; when another motion stoppage exceeds a time threshold: activating another indicator depicting another reduced resistance; and altering power to the exercise machine to further reduce the resistance.

22 Claims, 11 Drawing Sheets

(56) References Cited

U.S. PATENT DOCUMENTS

| | | | | |
|---|---|---|---|---|
| 5,823,921 | A * | 10/1998 | Dawson | A63B 21/00181 482/93 |
| 12,239,871 | B1 * | 3/2025 | Ilfrey | A63B 21/153 |
| 12,290,721 | B2 * | 5/2025 | Meckenzie | A63B 21/072 |
| 2012/0244999 | A1 * | 9/2012 | Tauriainen | A63B 21/078 482/104 |
| 2013/0203558 | A1 * | 8/2013 | Lemos | A63B 21/154 482/93 |
| 2014/0228175 | A1 * | 8/2014 | Lemos | A63B 21/0783 482/93 |
| 2014/0278229 | A1 * | 9/2014 | Hong | H04W 4/027 702/160 |
| 2015/0360083 | A1 * | 12/2015 | Lagree | A63B 23/0405 482/130 |
| 2017/0197103 | A1 * | 7/2017 | Rau | A63B 21/0057 |
| 2023/0277892 | A1 * | 9/2023 | Smith | A63B 21/00196 482/129 |
| 2024/0261623 | A1 * | 8/2024 | Cohen | A63B 21/0058 |
| 2024/0342544 | A1 * | 10/2024 | Cohen | A63B 21/156 |

* cited by examiner

SYSTEMS AND METHODS FOR IMPLEMENTING GUIDED EXERCISE ROUTINES

CROSS REFERENCES TO RELATED APPLICATIONS

This application claims the benefit of priority of U.S. Provisional Patent Application No. 63/677,660, filed on Jul. 31, 2024, which is incorporated herein by reference in its entirety.

TECHNICAL FIELD

The present disclosure generally relates to the field of gamification of exercise routines. More specifically, the present disclosure relates to systems, methods, and devices for gamifying one or more exercise routines.

BACKGROUND

Pacing during performance of an exercise routine may be important for achieving an exercise goal and avoiding injury. However, some pacing technologies may cause an exercise routine to feel tedious and mechanical. This may diminish a user's motivation to persevere until their exercise goal is reached. Therefore, there is a need for unconventional innovative technologies to gamify pacing of exercise routines. Such gamification may transform an otherwise tedious exercise routine into a challenge, motivating users to continue pursuing the exercise routine until their goal is reached, and/or to improve on past performance. Various aspects of this disclosure address the forgoing issues and others.

A drop set is a training technique that permits an exerciser to perform exercise repetitions until muscle fatigue is reached. At that point, a trainer may reduce an exercise load to permit the exerciser to continue performing exercise repetitions at the lesser load. A goal of drop sets is to increase workout intensity and volume. This may lead to greater muscle hypertrophy and endurance.

SUMMARY

Some disclosed embodiments may include systems, methods, and non-transitory computer readable media for performing electronic exercise machine control operations. Performing electronic exercise machine control operations may include: receiving a prompt to initiate a varying weight routine on a motorized resistance exercise machine for a particular user; retrieving ability-related information about the particular user; using the ability-related information to determine an initial resistance level for the particular user; activating on a display, an initial graphical progress indicator depicting the initial resistance level and including an initial variable display region; adjusting power to a motor of the motorized resistance exercise machine to cause the motor to exert an initial resistance force corresponding to the initial resistance level; as the particular user exerts forces on the motor countering the initial resistance level, monitoring a plurality of initial resistance level repetitions; upon detection of each of the plurality of initial resistance level repetitions, updating the initial variable display region to reflect initial resistance level repetition completions; detecting an initial motion stoppage during force exertion at the initial resistance level by the particular user; determining whether the initial motion stoppage at the initial resistance level exceeds an initial time threshold; when the initial motion stoppage at the initial resistance level exceeds the initial time threshold: activating a first additional graphical progress indicator depicting a first reduced resistance level and including a first reduced variable display region; and altering an electrical characteristic applied to the motor to cause the motor to exert a first reduced resistance force less than the initial resistance force; as the particular user exerts forces on the motor countering the first reduced resistance level, monitoring a plurality of first reduced resistance level repetitions; upon detection of each of the plurality of first reduced resistance level repetitions, updating the first reduced variable display region to reflect first reduced repetition completions; detecting a first motion stoppage during force exertion at the first reduced resistance level by the particular user; determining whether the first motion stoppage exceeds a first time threshold; and when the first motion stoppage exceeds the first time threshold: activating a second additional graphical progress indicator depicting a second reduced resistance level and including a second reduced variable display region; and altering the electrical characteristic applied to the motor to cause the motor to exert a second reduced resistance force less than the first reduced resistance force.

DETAILED DESCRIPTION

Figure 1:
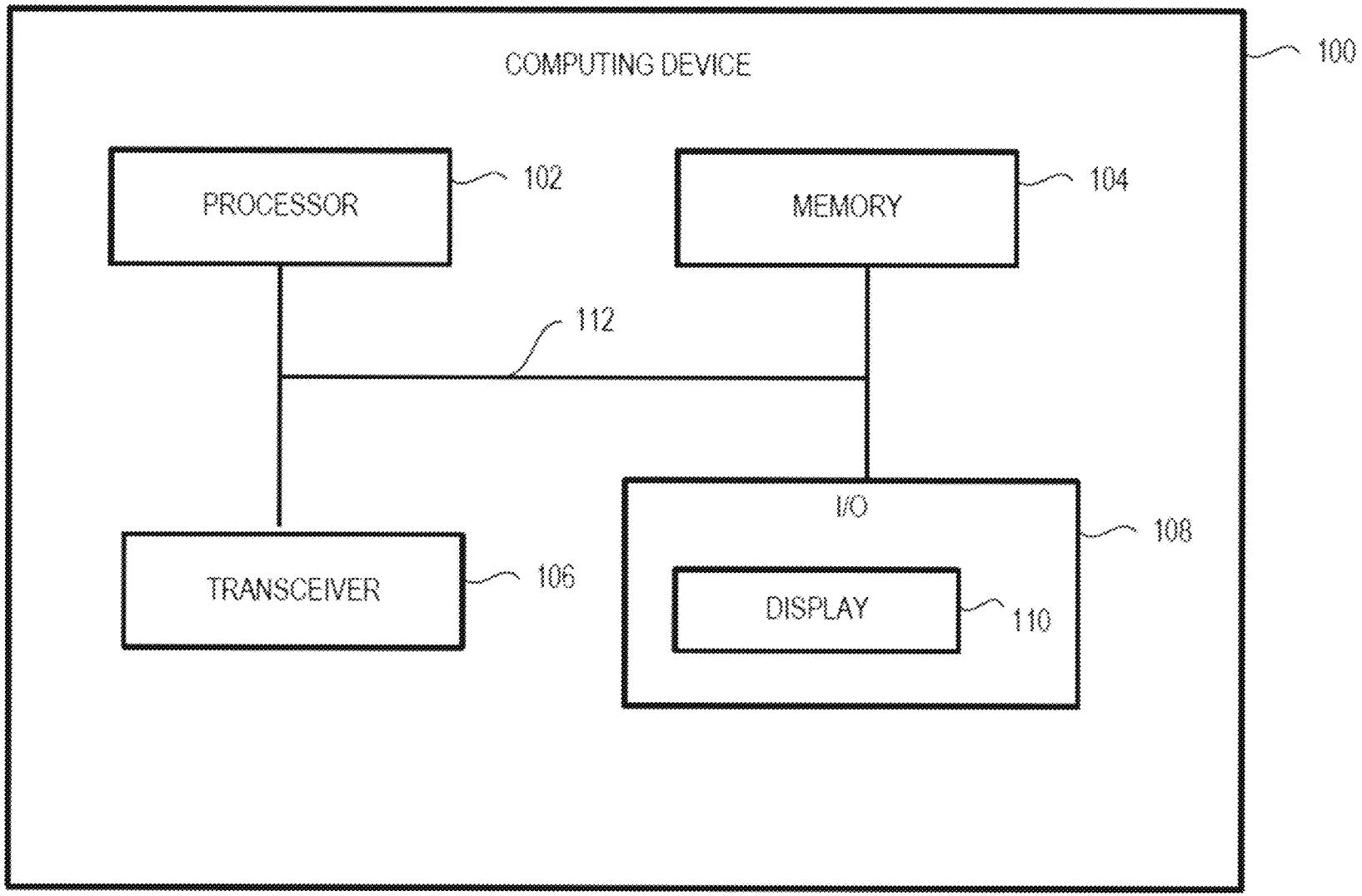
FIG. 1 is an exemplary schematic diagram of a computing device, consistent with some disclosed embodiments.

The following detailed description refers to the accompanying drawings. Wherever possible, the same reference numbers are used in the drawings and the following description to refer to the same or similar parts. While several illustrative embodiments are described herein, modifications, adaptations and other implementations are possible. For example, substitutions, additions, or modifications may be made to the components illustrated in the drawings, and the illustrative methods described herein may be modified by substituting, reordering, removing, or adding steps to the disclosed methods. Accordingly, the following detailed description is not limited to the specific embodiments and examples, but is inclusive of general principles described herein and illustrated in the figures in addition to the general principles encompassed by the appended claims.

Various aspects of this disclosure are disclosed in various paragraphs arranged for organizational purposes only and are not meant to suggest that separate paragraphs or paragraphs remote from each other correspond to a separate disclosure. Rather, it is to be understood that inventive aspects of this disclosure may lie in combinations of any aspects presented herein, regardless of their location in this disclosure.

This disclosure employs open-ended permissive language, indicating for example, that some embodiments "may" employ, involve, or include specific features. The use of the term "may," and other open-ended terminology is intended to indicate that although not every embodiment may employ the specific disclosed feature, at least one embodiment employs the specific disclosed feature.

Some embodiments described herein involve an exercise machine. An exercise machine may refer to a mechanical apparatus or electromechanical apparatus that may be used to perform physical exercise. For example, an exercise machine may include an electronic exercise machine, as described in the succeeding paragraph. Examples of exercise machines may include wall-mountable resistance devices, free standing resistance devices, treadmills, stationary bicycles, elliptical machines, weight machines, other resistance machines, and/or any other machine designed to engage a user in physical exercise.

Some disclosed embodiments involve an electronic exercise machine. An electronic exercise machine may refer to an exercise machine including a resistance motor associated with electronics for controlling the resistance. The electronics may control an amount of resistance applied during a weight resistance exercise by regulating, for example, a level, a frequency, a duration, a speed, a duty cycle, a range of motion, an exercise type, an operational mode, and/or any other attribute associated with resistance applied by a resistance motor. In some embodiments, electronics, including for example, at least one processor, may control force applied by a resistance motor in response to one or more user inputs.

In some embodiments, an electronic exercise machine may be associated with a user interface. Such a user interface may include one or more of an electronic display, a touch-sensitive screen, a microphone, a speaker, a haptic interface, a light emitting diode (LED), one or more adjustable dials, knobs, buttons, switches, and/or levers and/or any other type of manipulatable control enabling user inputs and/or information display. For example, a user may provide one or more inputs via a user interface associated with an electronic exercise machine to initiate, select, modify, share, and/or terminate an exercise routine. Such an interface may initiate signals to at least one processor associated with an electronic exercise machine. In a similar manner, the at least one processor may transmit one or more signals to convey information via a user interface to a user of an electronic exercise machine.

Some disclosed embodiments involve an electromagnet. An electromagnet may refer to a temporary magnet created by intermittent electrical currents. For example, an electromagnet may be formed by passing an electrical current through an electrically conductive wire wrapped around a piece of magnetic metal to produce an electromagnetic field. Some examples of electrically conductive wires may include copper, steel, and/or aluminum wires. Some examples of magnetic metal may include cast iron, wrought iron, galvanized steel, ferritic and martensitic stainless steel. The strength of an electromagnetic field produced by an electromagnet may be increased, decreased, or terminated by controlling a level of electrical current through the wire. Electromagnetic fields produced by one or more electromagnets may be used to introduce resistance to mechanical motion. Overcoming such resistance may require an application of a mechanical force.

Some disclosed embodiments involve a motor (e.g., a resistance motor). Such a motor may include a one or more electromagnets configured to apply a variable electromagnetic field as resistance. For example, a level of resistance produced by a resistance motor may correspond to an amount of weight (e.g., "digital weight") needed to be overcome by muscles during performance of a weight-bearing exercise. A resistance motor may be associated with at least one processor configured to control a level of electrical current flowing therethrough, allowing the at least one processor to control attributes associated with resistance or digital weight produced by the resistance motor. In some embodiments, a resistance motor may be associated with a lower bracket configured to connect a bottom end of a vertical wall-mountable beam to a wall. For example, a resistance motor may be located inside a housing configured as a lower bracket for connecting a vertical wall-mountable beam to a wall. A lower bracket may be made of durable metal, such as stainless or galvanized steel, or aluminum.

Some disclosed embodiments involve a motorized resistance exercise machine. A motorized resistance exercise machine may refer to an electronic exercise machine including a frame, e.g., a vertically wall-mountable beam, a resistance motor and a cable and/or rod mechanically coupling the resistance motor to an accessory configured to be manipulated by a user. As the user exerts an (e.g., pulling and/or pushing) force on the accessory, the force may be transferred to the cable and/or rod, which may impose the force on the resistance motor. The resistance motor may exert a resistance force to at least partially overcome the force imposed by the user. At least one processor may control the resistance force applied by the resistance motor to thereby control the resistance that a user must overcome to complete an exercise repetition. The resistance force may be measured as a weight (e.g., in pounds or lbs, and/or kilograms of kg). The frame may be configured for attachment to a wall via a plurality of supporting brackets, and/or may be a stand-alone frame. The frame and/or brackets may be made of durable metal (e.g., steel and/or aluminum) for sturdiness and may support a pulley system, allowing a first end of a cable to be connected to a resistance motor and a second end of the cable to be connected to exercise equipment. In some embodiments, a motorized resistance exercise machine may include a user interface (e.g., including one or more adjustable dials, knobs, buttons, switches, and/or levers) allowing interaction with a controller of the wall-mountable exercise machine, e.g., to receive feedback and/or customize a workout to meet a fitness level and/or goal. For example, a dial may allow a user to adjust a resistance of the resistance motor, and a button may allow changing a direction and/or mode for exerting a force on a cable. At least one processor may receive a signal from the dial indicating a selected resistance level and apply the signal to control the resistance motor to apply a resistance force at the selected resistance level.

Some disclosed embodiments may involve a cable. A cable may include a rope, cord, chain, belt, and/or any other band or cordage having a tensile strength for withstanding repeated applications of tension. A cable may include a plurality of fibers (e.g., stainless and/or galvanized steel) that may be combined and twisted to form an elongated structure, and may optionally include a coating such as nylon and/or PVC to reduce friction and wear. In some embodiments, a cable may have a tensile strength suitable for withstanding a resistance force associated with a resistance motor of an electronic exercise machine. For instance, a first end of a cable may connect to a resistive motor and a second end of the cable may connect to a moveable arm of an electronic exercise machine, allowing for a mechanical force applied to move the arm to be at least partially resisted by the resistive motor.

Some disclosed embodiments may involve a pulley or a pulley system. Either such term refers to a mechanical device including at least one wheel that acts to change the direction of a force applied to a cable circumscribing the wheel. The wheel may have a grooved edge or rim around which the cable passes. The pulley may be supported by a frame or shell (e.g., a block) for guiding a cable around the wheel such that rotation of the wheel may cause a direction of the cable to change (e.g., such that a downwards motion on one end of the cable may cause a corresponding upwards motion on the other end of the cable and the reverse). In some embodiments, a vertical wall-mountable beam may include a pulley located at an upper section thereof. A pulley of a vertical wall-mountable beam may be associated with an upper bracket configured to affix an upper end of the vertical wall-mountable beam to a wall. For example, a pulley may be located inside a housing configured as an upper bracket for connecting a vertical wall-mountable beam to a wall. The upper bracket may be made of durable metal, such as stainless or galvanized steel, or aluminum.

Some embodiments may involve a computing device. A computing device as used herein may include any type of device capable of executing instructions using at least one processor. Such a computing device may include a smartphone, a tablet, a smartwatch, a personal digital assistant, a desktop computer, a laptop computer, an IoT device, a dedicated terminal, a wearable computing device, a client device, a server, and/or any other electronic device that enables computation. A computing device may include at least one processor, at least one memory, a transceiver, and an input/output unit, all interconnected via one more buses.

The at least one processor may include any physical device or group of devices having electric circuitry that performs a logic operation on an input or inputs. For example, the at least one processor may include one or more integrated circuits (IC), including application-specific integrated circuit (ASIC), microchips, microcontrollers, microprocessors, all, or part of a central processing unit (CPU), graphics processing unit (GPU), digital signal processor (DSP), field-programmable gate array (FPGA), server, virtual server, or other circuits suitable for executing instructions or performing logic operations. In some embodiments, the at least one processor may include a remote processing unit (e.g., a "cloud computing" resource) accessible via a communications network.

The at least one memory may include a Random Access Memory (RAM), a Read-Only Memory (ROM), a hard disk, an optical disk, a magnetic medium, a flash memory, other permanent, fixed, or volatile memory, or any other mechanism capable of storing instructions. Such a memory may be pre-loaded with instructions for execution by at least one processor. In some embodiments, the at least one memory may include a remote storage (e.g., "cloud" storage) accessible via a communications network.

In some embodiments, a computing device may include a communications device capable of exchanging data using a wired and/or wireless communications network. Such a communications network may include one or more of a digital communications network, an analog communication network, and/or any other communications network configured to convey data. Some examples of communications networks may include the Internet, a private data network, a virtual private network using a public network, a Wi-Fi network, a LAN, or WAN network, and/or any combination thereof. In some embodiments, a network may include one or more physical links used to exchange data, such as Ethernet, coaxial cables, twisted pair cables, fiber optics, or any other suitable physical medium for exchanging data. A network may also include a public switched telephone network ("PSTN") and/or a wireless cellular network. A network may be a secured network or unsecured network. In other embodiments, one or more components of the system may communicate directly through a dedicated communication network. Direct communications may use any suitable technologies, including, for example, BLUETOOTH™, BLUETOOTH LET (BLE), Wi-Fi, near field communications (NFC), or other suitable communication methods that provide a medium for exchanging data and/or information between separate entities.

Some embodiments may involve at least one sensor. Some examples of sensors may include a camera (e.g., an image sensor), a motion sensor (e.g., an inertial measuring unit), a voltage and/or current sensor, an ultrasound sensor, a touch-sensitive sensor, a positioning sensor (e.g., an indoor and/or outdoor positioning sensor), encoder sensor, potentiometer, load cell, accelerometer, laser displacement sensor, inductive proximity sensor and/or any other device capable of outputting a signal indicative of physical movement.

Some disclosed embodiments involve an electronic display. An electronic display includes any device or element capable of generating a visible image from electrical signals. For example, an electronic display may include a display (e.g., LCD or dot-matrix screen), an electroluminescent (EL) display, a liquid crystal display (LCD), light-emitting diode (LED)-backlit Liquid crystal display (LCD), a light-emitting diode (LED) display, an organic light-emitting diode (OLED) display, an active matrix organic light-emitting diode (AMOLED) display, a plasma (P) display, a quantum dot (QD) display, and/or any other type of technology for rendering information visually. At least one processor may transmit signals to an electronic display to cause information to be displayed visually.

Some disclosed embodiments involve a speaker. A speaker may include any element or device capable of outputting sound. For example, a speaker may include one or more transducers for converting electromagnetic waves into sound waves. At least one processor may transmit signals to a speaker to cause information to be rendered as sound.

Some disclosed embodiments involve a light indicator. A light indicator may include any element or device that emits light in order to convey information. (e.g., indicating that a machine is powered on, indicating a mode of operation, indicating proper or improper usage, or indicating any other information. A light indicator may include a single light source (e.g., an LED), an array of light sources, (e.g., an LED array associated with different colors). At least one processor may transmit signals to a light indicator to cause information to be rendered visually.

Some disclosed embodiments involve a data structure. Structured data may include any collection of data values and relationships among them. The data may be stored linearly, horizontally, hierarchically, relationally, non-relationally, uni-dimensionally, multidimensionally, operationally, in an ordered manner, in an unordered manner, in an object-oriented manner, in a centralized manner, in a decentralized manner, in a distributed manner, in a custom manner, or in any manner enabling data access. By way of non-limiting examples, data structures may include an array, an associative array, a linked list, a binary tree, a balanced tree, a heap, a stack, a queue, a set, a hash table, a record, a tagged union, ER model, and a graph. For example, a data structure may include an XML database, an RDBMS database, an SQL database or NoSQL alternatives for data storage/search such as, for example, MongoDB, Redis, Couchbase, Datastax Enterprise Graph, Elastic Search, Splunk, Solr, Cassandra, Amazon DynamoDB, Scylla, HBase, and Neo4J. A data structure may be a component of the disclosed system or a remote computing component (e.g., a cloud-based data structure). Data in the data structure may be stored in contiguous or non-contiguous memory. Moreover, a data structure, as used herein, does not require information to be co-located. It may be distributed across multiple servers, for example, that may be owned or operated by the same or different entities. As used herein, the term "data structure" may include a data pool or may be included in a data pool. It is further to be understood that the term "data structure" as used herein in the singular is inclusive of plural data structures. A data structure may also include any hardware, software, firmware, or combination thereof for storing and facilitating the retrieval of information.

By way of other examples, a data structure may include semi-structured database. A semi-structured database may combine elements of structured and unstructured data. Some types of semi-structured databases may include an ontological database, a semantic database, a NoSQL database, and/or databases based on a hierarchical and/or graph-based schema. A semi-structured database may be based on one or more technologies, such as a Resource Description Framework (RDF) and/or a Web Ontology Language (OWL), JavaScript Object Notation (JSON) formatting, and/or any other form of data. Some examples of semi-structured databases may include MongoDB®, CouchDB®, Cassandra®, Neo4j®, Amazon DynamoDB®, Elasticsearch, Firebase Realtime Database®, Apache HBase®, MarkLogic®, and/or OrientDB®.

A data pool may include a centralized repository and/or collection of data, such as a data warehouse, a data lake, and/or a cloud-based data repository. A data pool may include structured, semi-structured, and/or unstructured data. A data pool may consolidate data from different sources, ensuring that the data may be available for analysis, reporting, decision-making, and other data-driven activities. Data pools may provide a rich data set for training machine learning models, by permitting aggregation of diverse data sets generated by differing data sources at different times and different contexts.

Some disclosed embodiments involve a mobile communications device. A mobile communications device is a portable electronic instrument designed to facilitate information transmission to other devices or networks. Mobile communications devices may, for example, use cellular or other wireless and/or wired networks to transmit information such as voice and/or other data. For example, such transmissions may be in the form of voice calls, text messages, internet access, and application usage.

Mobile communications devices come in various forms, such as smartphones, tablets, laptop computers, IoT devices, wearable electronics (such as smart watches, smart rings, fitness trackers, smart glasses, smart clothing, smart jewelry, smart headphones, wearable digital assistants), and portable wireless hotspots. Depending on configuration and intended use, they may include features such as a touchscreen interface, a built-in camera, Wi-Fi, NFC, and/or Bluetooth connectivity, and GPS navigation.

Some disclosed embodiments involve a power source. A power source may include any element, device, or system for providing electrical energy to an electrical load or a circuit. Examples of power sources include one or more batteries (e.g., a lead-acid battery, a lithium-ion battery, a nickel-metal hydride battery, a nickel-cadmium battery), fuel cells, generators, capacitors, power converters, or connections (e.g., an electrical wall outlet) to an external source of electrical energy (e.g., an electric grid or other mechanism for supplying electricity). A power source may further include combinations of any of the foregoing.

Some disclosed embodiments involve a communications network. A communications network may include any type of physical or wireless infrastructure used to exchange data. For example, a communications network may be the Internet, a private data network, a virtual private network using a public network, a Wi-Fi network, a LAN or WAN network, a combination of one or more of the forgoing, and/or other suitable connections that may enable information exchange among or between various system components. In some embodiments, a communications network may include one or more physical links used to exchange data, such as Ethernet, coaxial cables, twisted pair cables, fiber optics, or any other suitable physical medium for exchanging data. A communications network may also include a public switched telephone network ("PSTN") and/or a wireless cellular network. A communications network may be secured or unsecured network. In other embodiments, one or more system components may communicate directly through a dedicated communications network. Direct communications may use any suitable technologies, including, for example, BLUETOOTH™, BLUETOOTH LET (BLE), Wi-Fi, near field communications (NFC), or other suitable communication methods that provide a medium for exchanging data and/or information between separate entities.

A communications network may include a plurality of nodes interconnected via network infrastructure allowing encoded information to flow therebetween. Such network infrastructure may include, for example, one or more routers, switches, boosters, cables (e.g., Ethernet, coaxial cables, twisted pair cables, fiber optics, wires, buses), antennae, and/or any other wired and/or wireless computer networking technology configured for exchanging data.

Some disclosed embodiments involve a network interface. A network interface may include electronic circuitry and/or software code enabling at least one processor to communicate with another processor or processors via a network according to a communications protocol (e.g., Transmission Control Protocol/Internet Protocol or TCP/IP). Such circuitry may include, for example, at least one processor, a memory, one or more antennae configured to send and/or receive wireless signals from other devices, one or more wires and/or cables configured to send and/or receive wired signals from other devices, a plurality of physical and/or virtual ports, one or more software interface layers for implementing one or more communications protocols (e.g., lower layer protocols such as TCP, User Datagram Protocol (UDP), IP, and Internet Control Message Protocol (ICMP), and application layer protocols, such as Hypertext Transfer Protocol (HTTP), Secure Socket Shell (SSH), Transport Layer Security (TLS), and Secure Sockets Layer (SSL), and/or any other component required to enable networked communication between a plurality of computing devices.

Some disclosed embodiments involve a cloud service. A cloud service is a product that enables access to computing resources, such as servers, storage, and applications, over a network such as the internet. Cloud services are typically provided by third-party vendors who manage and maintain the underlying infrastructure allowing users to access and use the services via the internet. Non-limiting examples of types of cloud services, include Infrastructure as a Service (IaaS), Platform as a Service (PaaS), and Software as a Service (Saas). In some embodiments, a cloud service may execute program code instructions to implement one or more virtual machines.

In some embodiments, a communications network may be associated with a client-server model, allowing a cloud service to provide data storage and/or computational services to one or more client devices via the communications network. For example, a cloud service may store data and software associated with one or more electronic exercise machines and/or mobile communications devices (e.g., client devices) and/or execute program code instructions associated with using one or more electronic exercise machines. For example, a cloud server may store data and/or execute program code instructions for implementing a plurality of operational modes for an electronic exercise machine (e.g., in association with one or more exercise routines), creating an interface between a mobile communications device and one or more electronic exercise machines, and/or pairing two or more modular electronic exercise machines.

As another example, a cloud server may store data and execute program code instructions associated with performances of exercise routines (e.g., with or without an electronic exercise machine). For example, a cloud server may store results or achievements and/or provide feedback associated with performances of exercise routines (e.g., by a single or by multiple users), provide instructions for using an electronic exercise machine and/or for implementing differing modes of operation of an electronic exercise machine, facilitate interactions between remote users performing exercise routines (e.g., with or without an electronic exercise machine), and/or provide any other service associated with performances of exercise routines.

Some disclosed embodiments may involve signals. Signals may refer to an electrical or electromagnetic wave that carries information such as voice, video, or data. Signals can take various forms, including analog signals and digital signals. Other signal examples include radio signals, optical signals, microwave signals, infrared signals, ultrasonic signals, or any other wave or other conveyance that carries information. Non-limiting examples of signals include signals in the electromagnetic radiation spectrum (e.g., AM or FM radio, Wi-Fi, Bluetooth, radar, visible light, lidar, IR, Zigbee, Z-wave, and/or GPS signals), sound or ultrasonic signals, electrical signals (e.g., voltage, current, or electrical charge signals), electronic signals (e.g., as digital data), tactile signals (e.g., touch), and/or any other type of information encoded for transmission between two entities via a physical medium.

By way of a non-limiting example, reference is made to FIG. 1 illustrating an exemplary schematic diagram of a computing device 100, consistent with some disclosed embodiments. Computing device 100 may include at least one processor 102, at least one memory 104 (e.g., a non-transitory computer readable medium), a transceiver 106, and an input/output (I/O) unit 108. At least one processor 102, at least one memory 104, transceiver 106, and input/output unit 108 may be interconnected via a bus 112. In some embodiments, input/output unit 108 may include an electronic display 110. Electronic display 110 may include one or more touch sensitive surfaces, permitting computing device 100 to receive inputs from a user, and present outputs to a user.

Figure 2:
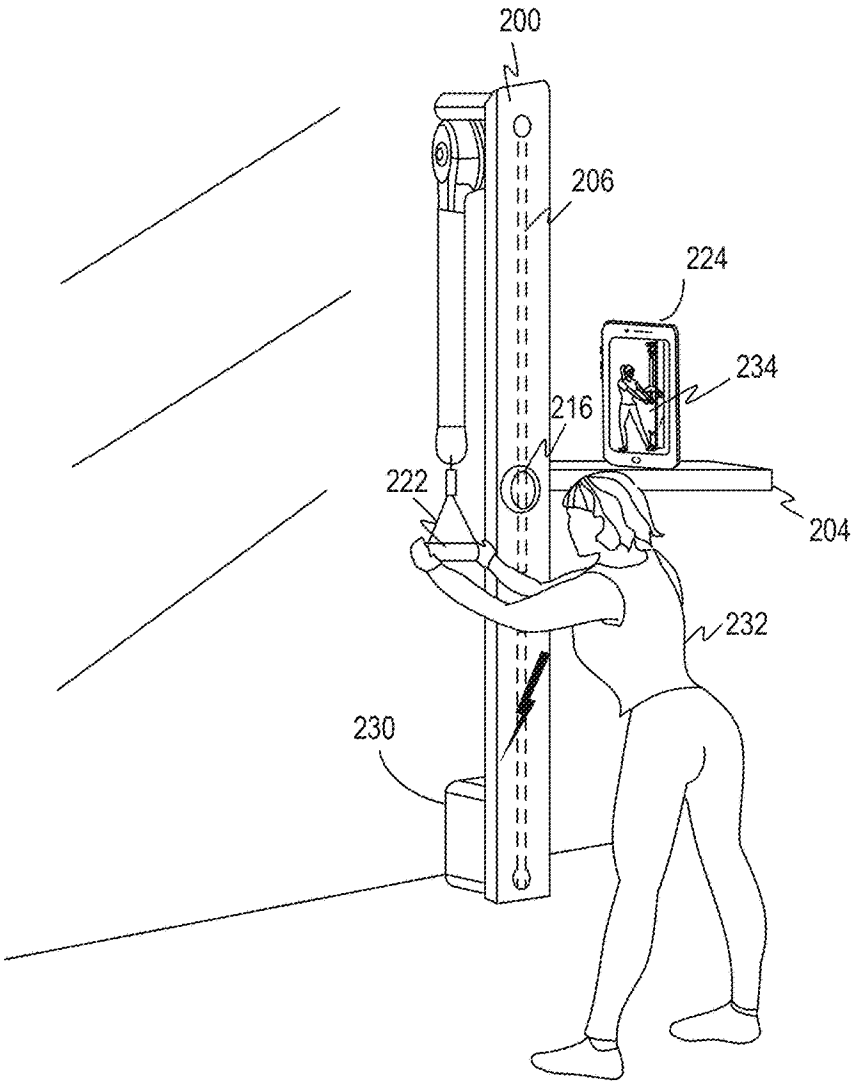
FIG. 2 is a perspective view of a user interacting with an exemplary electronic exercise machine, consistent with some disclosed embodiments.

By way of a non-limiting example, reference is made to FIG. 2 illustrating an exemplary motorized resistance exercise machine 200 (e.g., a motorized resistance exercise machine), consistent with some disclosed embodiments. Electronic exercise machine 200 may include at least a resistance motor 230 housed in a lower bracket, and associated with a cable 206. In some embodiments, motorized resistance exercise machine 200 may include a shelf 204 for supporting a mobile communications device 224 paired thereto. In some embodiments, motorized resistance exercise machine 200 may be wall-mountable.

Figure 3:
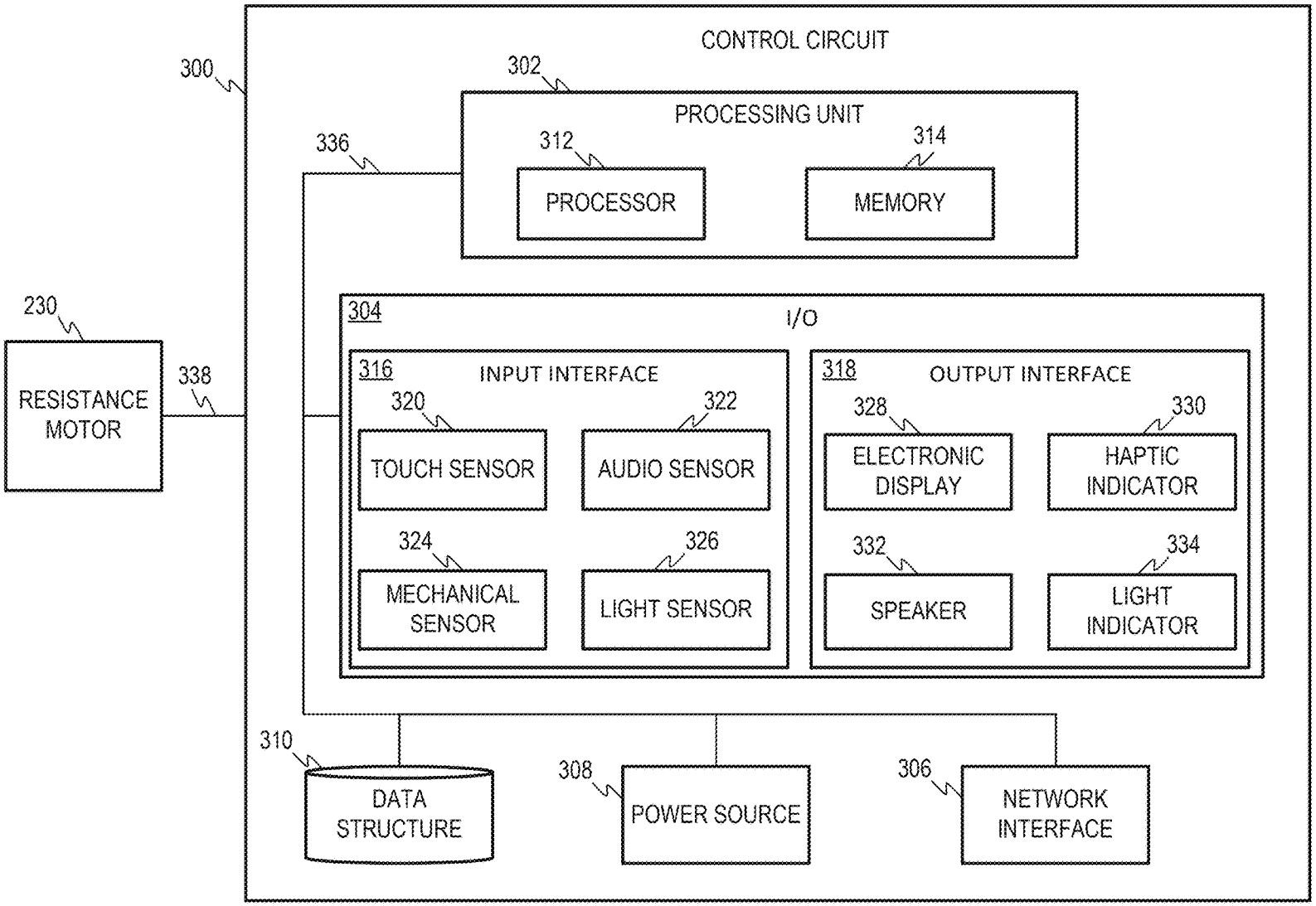
FIG. 3 is an exemplary block diagram of circuitry associated with an electronic exercise machine, consistent with some disclosed embodiments.

By way of a non-limiting example, reference is made to FIG. 3 illustrating an exemplary block diagram representing circuitry 300 associated with an electronic exercise machine, consistent with some disclosed embodiments. Circuitry 300 may include at least one processor 312 and an associated memory 314 (e.g., corresponding to processor 102 and memory 104 in FIG. 1). At least one processor 312 may transmit signals for controlling a resistance force exerted by motor 230 on cable 206. Circuitry 300 may include a network interface 306 for pairing to mobile communications device 224, a speaker 323 for outputting an audio signal, and a sensor 324 (e.g., a motion sensor) for detecting motion and/or stoppage of motion associated with cable 206. Network interface 306 may send and/or receive signals, such as electromagnetic signals (e.g., AM or FM radio, Wi-Fi, Bluetooth, radar, visible light, lidar, IR, Zigbee, Z-wave, and/or GPS signals), sound or ultrasonic signals, electrical signals (e.g., voltage, current, or electrical charge signals), electronic signals (e.g., as digital data), tactile signals (e.g., touch), and/or any other type of signals that convey information and communicate signals to at least one processor (e.g., processor 312).

Figure 4:
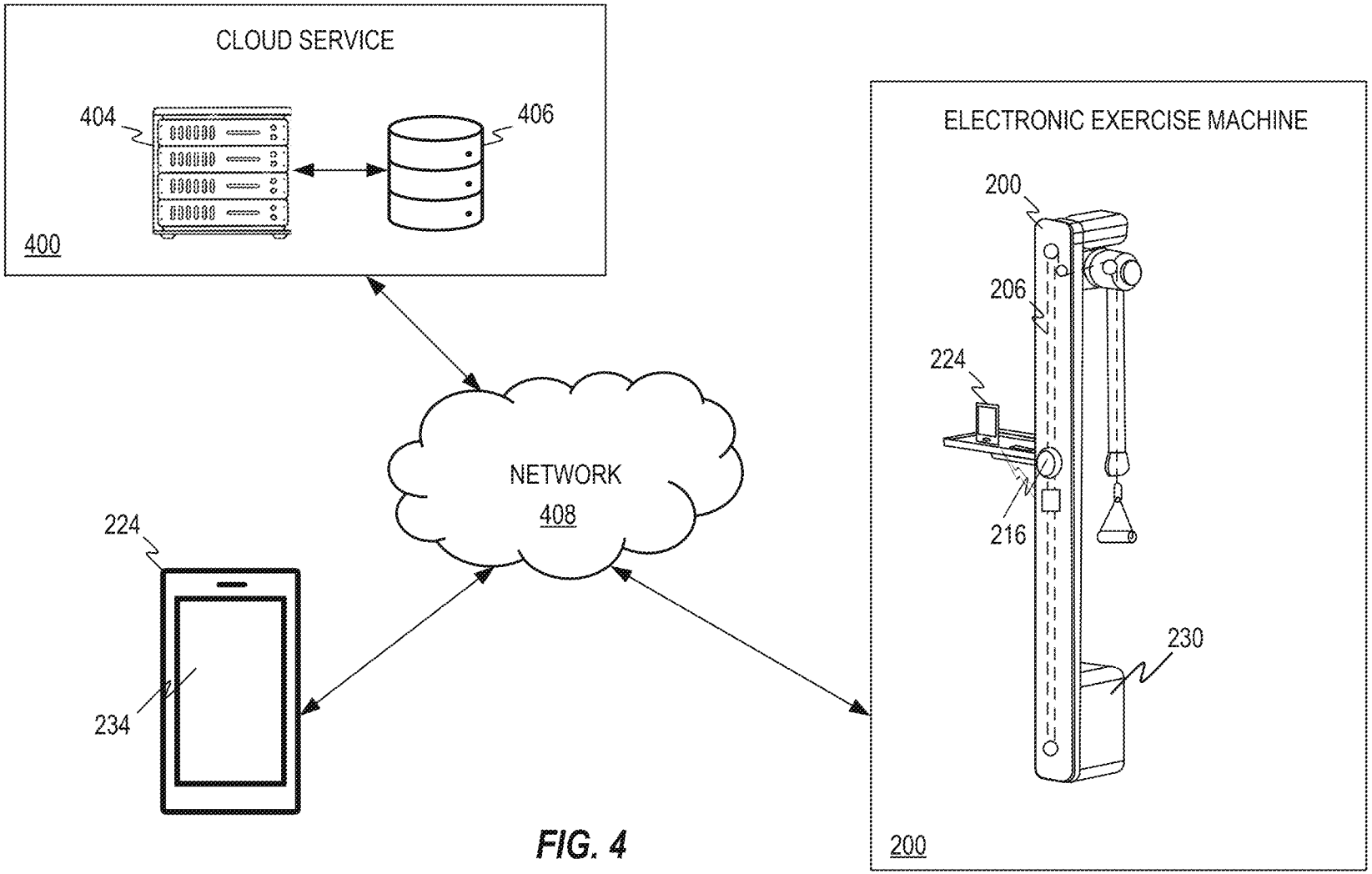
FIG. 4 illustrates an exemplary cloud service environment associated with the motorized resistance exercise machine, consistent with some embodiments of the present disclosure.

By way of a non-limiting example, reference is made to FIG. 4, which is a schematic illustration of a cloud service 400 associated with motorized resistance exercise machine 200, consistent with some embodiments of the present disclosure. Cloud service 400 includes at least one server 404 (e.g., including at least one processor), and a data repository 406 connected to a communications network 408. Data repository 406 may store and/or correspond to any of the data structures previously described. Cloud service 400, motorized resistance exercise machine 200 and mobile communications device 224 may communicate via communications network 408. Each of cloud service 400, motorized resistance exercise machine 200, and mobile communications device 224 may include a computing device, such as illustrated in FIG. 1. In some embodiments, communications network 408 may include a dedicated communications network, such as a Bluetooth communications channel connection connecting mobile communications device 224 with at least one processor (e.g., processor 102 and/or processor 312) of motorized resistance exercise machine 200. In some embodiments, a light sensor (e.g., a camera) associated with mobile communications device 224 may capture sequences of images of a user performing exercise repetitions using motorized resistance exercise machine 200. At least one processor may display the one or more image sequences as a video via an electronic display of mobile communications device 430. Cloud service 400 may store and analyze the images and/or videos associated with motorized resistance exercise machine 200 to provide feedback and/or instructions to a user performing an exercise routine, and/or provide any other service associated with performances of exercise routines (e.g., with or without wall-mountable electronic exercise machine 200). Network interface 306 may transmit data sensed by one or more of sensors 320, 322, 324, and/or 326 (and/or additional sensors of motorized resistance exercise machine 200) to at least one processor, such as processor 312 included in motorized resistance exercise machine 200, processor 102 included in mobile communications device 224, and/or processor 102 included in cloud service 400.

Some disclosed embodiments involve electronic exercise machine controls for enhanced drop set implementation. Electronic exercise machine controls may include mechanical and/or digital components and/or interfaces that manage how an exercise machine operates. For example, depending on implementation, they let users start, stop, adjust, and monitor their workouts, and they enable the machine to respond to inputs and track performance. In the context of electronic exercise machines or strength training, a drop set is a weight training technique where a user performs an exercise until reaching muscle fatigue, and then reduces (drop) the weight and continues without resting. Enhanced drop set implementation involves mechanisms for encouraging a user to progress with drop sets. For example, an enhanced drop set implementation may involve gamification where automatic reduction of a resistance force exerted by a resistance motor of an electronic exercise machine may occur in response to detection of fatigue. Concurrently, implementation of gamified drop sets may involve displaying indicators tracking progress of the exercise routine on a display, where each drop set may be indicated graphically.

As used herein, receiving (e.g., signals) refers to obtaining, acquiring, and/or otherwise gaining access to information (e.g., locally and/or over a distance). In some embodiments, receiving may include retrieving. Receiving may be performed on a wired and/or wireless channel, and/or via a bus system internal to a computing device. Receiving may involve connecting to a network, detecting an incoming signal at a receiver (e.g., an input port and/or antenna), and/or formatting the signal for storage in memory as digital data. In some embodiments, receiving may include decrypting received data.

As used herein, retrieving refers to reading, obtaining, and/or gaining access to something. In some embodiments, retrieving may include receiving. Retrieving (e.g., data) may include accessing and/or querying a local and/or remote data structure for data, accessing data stored in a buffer associated with a user interface device (e.g., via a buffer function), and/or accessing any other type of data and/or data storage.

As used herein, detecting refers to sensing, perceiving, discovering, recognizing, and/or identifying. Detecting may include identifying, recognizing, and/or discovering something by monitoring for patterns, signals, and/or anomalies that indicate certain events and/or conditions. Detection may be performed by a sensor, a receiver (e.g., a port and/or an antenna), and/or at least one processor, and may involve sensing a change in state from one time period to a subsequent time period.

As used herein, determining refers to arriving at an outcome. It may include, for example, undertaking an equality comparison to check whether two values are the same or are in a predetermined range. For example, the check may involve an equality operator like==in many languages (e.g., Python, JavaScript, C++). If the values are the same, the comparison evaluates to true; otherwise, it evaluates to false. Determining may additionally or alternatively include making a measurement, comparison, estimation, and/or calculation to arrive at a conclusive outcome.

As used herein, monitoring refers to checking, tracking, recording, and/or overseeing over time. Altering refers to changing, switching, and/or substituting. Resistance refers to a force exerted to counter or at least partially overcome another force. A resistance level refers to a degree and/or amount of resistance exerted by a resistance motor, e.g., to at least partially counter an exercise force by a user. Resistance level repetitions may include recurring motions of one or more pieces of exercise equipment due to manipulations of some or all portions of the exercise equipment by a user performing an exercise routine at a particular resistance level. Resistance level repetitions may correspond to motions performed by a user while exercising using a motorized resistance exercise machine set to a specific level of resistance. To exert (e.g., exerting) refers to expending energy (e.g., electrical and/or metabolic energy) to perform work.

A weight routine refers to a structured and/or repetitive set of physical movements. A weight routine may be divided into a plurality of exercise sets, each exercise set including a plurality of repetitions (e.g., pulling, pushing, lifting, lowering, stretching, twisting, squeezing, balancing, stepping, pedaling, and/or any other movement). Each repetition may involve performance of a similar motion by a user and may target a specific muscle group and/or fitness goal. Different exercise sets of a weight routine may vary from each other. For example, different exercise sets may be performed at different (e.g., increasing, decreasing, and/or modulating) resistance levels, different sets may include differing (e.g., increasing, decreasing, and/or modulating) numbers of repetitions, different sets may be performed at differing paces and/or over differing time durations, and/or different sets may be separated by pauses of differing durations.

Some disclosed embodiments involve performance of electronic exercise machine control operations. Electronic exercise machine control operations refers to actions, processes, and/or procedures for operating an electronic exercise machine. Some control operations for an electronic exercise machine may include transmission of signals to control a resistance level of a resistance force applied by a resistance motor, analysis of data to determine the resistance level, rendering of data on an electronic display (e.g., a graphical user interface or GUI) to permit tracking progress of a varying weight routine, and/or any other operation involved in controlling an electronic exercise machine.

Some disclosed embodiments involve receiving a prompt to initiate a varying weight routine on a motorized resistance exercise machine for a particular user. Receiving a prompt refers to receiving (as described above) a signal and/or stimulus for causing a course of action. For example, a motorized resistance exercise machine may electronically prompt an action by providing a graphical user interface requesting an input and/or response from a user. In some embodiments, electronically prompting may involve providing an interface, audible message or sound, or a haptic or light indicator, to cause the user to provide an input to the exercise machine. To initiate refers to begin, start, and/or introduce something, such as a process, action, and/or sequence of events. A varying weight routine refers to any exercise program where resistance varies over time (e.g., within a set or between sets). It may include a structured and/or repetitive set of physical movements, where at least one characteristic of the repetitive set of physical movements may change during a series of repetitions. The routine may vary based on user preference and/or as the result of at least one processor controlling the routine. The control by the processor may be based on current and/or past user performance. For example, in a varying weight routine, a resistance level applied by a resistance motor may vary for each exercise set, a pace and/or rate of repetitions in each set may vary, a number of repetitions per set may vary, a type of exercise motion for each exercise set may vary, a duration of one or more rest periods separating exercise sets may vary, and/or any other characteristic of a weight routine may vary. By way of example, a varying weight routine may include three exercise sets, each exercise set including twenty repetitions of an exercise movement at differing (e.g., increasing, decreasing, and/or modulating) resistance levels. By way of another example, an initial exercise set of a varying weight routine may include ten repetitions at an initial resistance level, a second exercise set may include fifteen repetitions at a second resistance level, and a third exercise set may include twenty repetitions at a third resistance level. A particular user refers to a specific individual initiating an exercise routine on a motorized resistance exercise machine (as described earlier). A particular user may be associated with a particular account, user identifier, exercise and/or fitness history, user preferences, settings, a particular exercise machine, location, and/or any other identifying information.

By way of a non-limiting example, in FIG. 2, at least one processor (e.g., processor 102 in FIG. 1) may receive a prompt to initiate a varying weight routine on motorized resistance exercise machine 200 for a particular user 232. Particular user 232 may provide the prompt via dial 216 of motorized resistance exercise machine 200, and/or using an electronic display 234 (e.g., a touch sensitive display) of mobile communication device 224.

Figure 5:
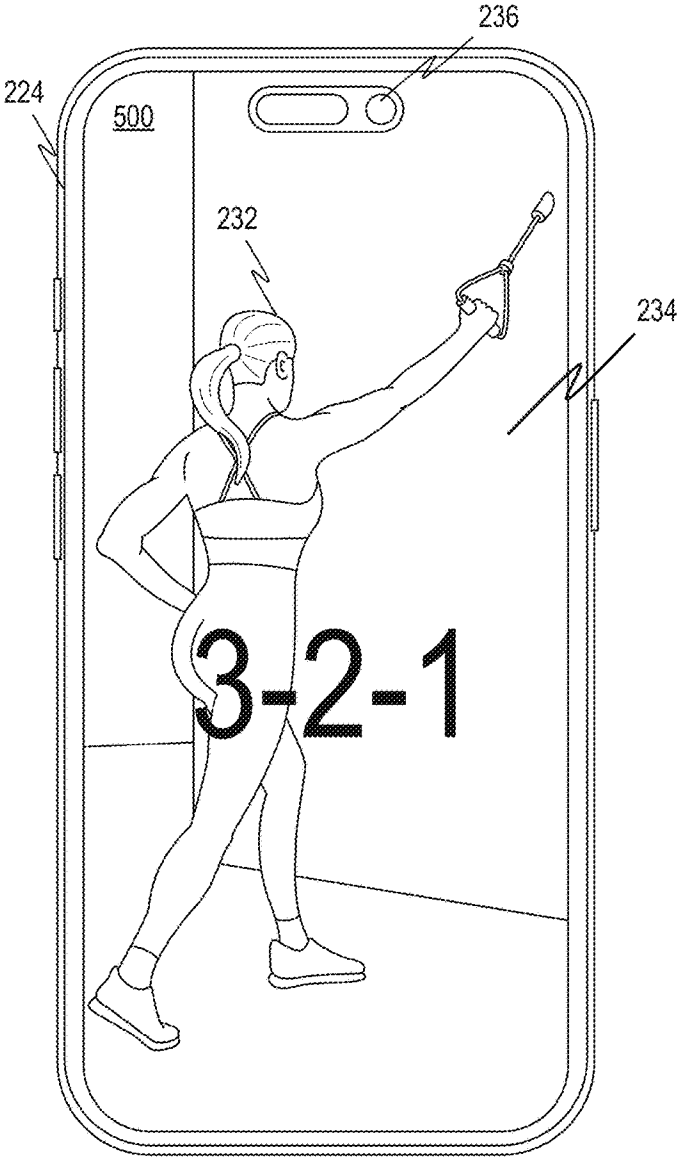
FIG. 5 is a front view of a mobile device display depicting a user preparing to perform a varying weight routine using a motorized resistance exercise machine, consistent with some disclosed embodiments.

By way of another non-limiting example, reference is made to FIG. 5, presenting an image 500 of particular user 232 preparing to perform a varying weight routine using motorized resistance exercise machine 200, consistent with some disclosed embodiments. Image 500 may be a portion of a video captured by a camera 236 of mobile communications device 224 paired to exercise machine 200, and/or additional image sensors during performance of the varying weight routine. For example, mobile communications device 242 may be positioned on shelf 204 in a manner to align camera 236 to capture images of particular user 232 using exercise machine 200. At least one processor may display at least one image 500 in real-time on an electronic display (e.g., display 234 of mobile communications device 242 and/or an electronic display included in motorized resistance exercise machine 200) to provide feedback to particular user 232. For example, in response to receiving a prompt from particular user 232 to initiate a varying weight routine on motorized resistance exercise machine 200, at least one processor may display a count-down (e.g., "3-2-1-GO") via mobile communications device 224 prompting particular user 232 to begin exercise repetitions at the initial resistance level.

Some disclosed embodiments involve retrieving ability-related information about the particular user. Ability-related information about a particular user refers to data and/or information associated with a capability of the particular user. Such ability-related information may include data related to strength, fitness and/or endurance metrics for the particular user (e.g., to perform one or more exercise routines), one or more user preferences and/or recommendations (e.g., professional and/or learned recommendations generated using artificial intelligence), a history of exercise routine performances, and/or any other information associated with a capacity for the particular user to perform exercise routines (e.g., varying weight routines). In some embodiments, ability-related information about a particular user may include ability-information about similar users, other than the particular user. For example, additional users may be classified with the particular user based on shared and/or common characteristics (e.g., size, weight, age, gender, location, social network, common exercise goal, club membership, exercise history and/or patterns, and/or any other characterizing information). Ability-related information may include a (e.g., maximum, minimum, average, and/or preferred) resistance level applied by a resistance motor, a (e.g., maximum, minimum, average, and/or preferred) number of exercise repetitions and/or sets, an (e.g., maximum, minimum, average, and/or preferred) exercise duration, a (e.g., maximum, minimum, average, and/or preferred) cardiovascular and/or metabolic rate for a particular user, and/or any other factor affecting a capability of a user to perform an exercise routine. Ability-related information may be specific to a particular muscle group, a type of motion (e.g., pulling, pushing, lifting, lowering, stretching, squeezing, balancing, pedaling, stepping, and/or twisting), a time of day (e.g., morning, noon, evening), a day of week (e.g., weekend vs workday), a context and/or exercise type (e.g., warm-up, strength training, endurance training, cool-down, group exercise, solo exercise), and/or any other factor affecting a capability to exercise. In some embodiments, ability-related information may be generated by a predictive model (e.g., based on artificial intelligence) applied to a history of previously performed weight routines. Retrieving ability-related information about a particular user may include accessing memory, e.g., by querying a local and/or remote data structure over a wired and/or wireless communication channel, prompting a user for ability-related information via a user interface, and/or polling a buffer and/or queue following the prompting.

In some disclosed embodiments, retrieving ability-related information about the particular user includes accessing a data repository containing prior workout session data about the particular user. Accessing a data repository may include reading and/or obtaining data from a data structure and/or data pool (as described above). A data repository may be associated with local memory (e.g., stored in a memory inside a personal computing device and/or exercise machine) and/or remote memory (e.g., in a server and/or cloud storage facility). Containing refers to storing, saving, and/or caching, e.g., data. Prior workout session data about a particular user refers to a history and/or record of previously performed exertion sessions by a specific user. Prior workout session data may include raw data recorded during one or more previous workout sessions, and/or data associated with analyzing and/or processing raw data, such as statistical metrics, summarizing reports, performance comparisons (e.g., to other workouts), workout trends, patterns and/or anomalies, exercising habits and/or preferences and/or associated correlations to prior exercise performance, and/or any other information associated with previously performed workout sessions by a particular user. Accessing a data repository containing prior workout session data about a particular user may involve querying a data repository with an identifier of the particular user and/or an associated account, and/or receiving one or more records associated with particular user in response to the query via a communications network.

In some disclosed embodiments, retrieving ability-related information about the particular user includes receiving as real-time input from the particular user, a resistance selection. Real-time input refers to data and/or information received within a sufficiently short time period to reflect a current situation and/or context. Receiving real-time input from a particular user may include prompting the particular user for information via a user interface, and receiving, from the particular user, a response to the prompt (e.g., via the user interface) within a sufficiently short time window such that the information may be relevant for applying to a current workout session, and/or an imminent and/or anticipated initiation of a workout session. Receiving real-time input from a particular user may additionally include obtaining a current resistance level for a resistance motor of a motorized resistance exercise machine used by the particular user. A resistance selection refers to a chosen and/or picked setting for a resistance level. A resistance selection may include a selection of a resistance level made by a particular user via a user interface of a motorized resistance exercise machine (e.g., using a dial, lever, switch, touch-screen, and/or microphone of the exercise machine) and/or via a user interface of an electronic device (e.g., a mobile communication device) paired to the motorized resistance exercise machine.

By way of a non-limiting example, in FIG. 4, at least one processor (e.g., processor 102 in FIG. 1 and/or processor 312 in FIG. 3) may retrieve ability-related information about particular user 232 from data repository 406. Data repository 406 may contain prior workout session data (e.g., a history) about particular user 232. Additionally or alternatively, at least one processor may retrieve ability-related information by receiving real-time input from particular user 232, e.g., via dial 216 (e.g., including a user interface) of motorized resistance exercise machine 200 and/or mobile communication device 224 paired thereto. The ability information may include a resistance selection, a total number of exercise sets for a varying weight routine, a number of repetitions for each exercise set, a time duration for each repetition, exercise set, and/or varying weight routine, a stoppage threshold between differing exercise sets, and/or any other data that may be used to control operation for motorized resistance exercise machine 200 during performance of a varying weight routine by particular user 232.

Some disclosed embodiments involve using the ability-related information to determine an initial resistance level for the particular user. An initial resistance level for a particular user refers to a starting and/or beginning resistance level (as described above) for the particular user. A particular user may start performance of an exercise routine while a resistance motor of the motorized resistance exercise machine applies an initial resistance level to at least partially resist forces applied by the user. As the user continues to apply forces during performance of the exercise routine, the initial resistance level applied by the resistance motor may change (e.g., either increase or decrease). For instance, the resistance level may change due to one or more user preferences and/or settings, a program and/or schedule for an exercise routine, an indication of fatigue and/or lack thereof (e.g., if the resistance level is too easy), and/or any other reason. By way of example, a schedule for a weight routine may include an initial exercise set of ten repetitions at a first resistance level, a second exercise set of fifteen repetitions at a second resistance level, and a third exercise set of twenty repetitions at a third resistance level. Using ability-related information to determine an initial resistance level for the particular user may include extracting an initial resistance level included in the ability-related information (e.g., directly), and/or estimating and/or inferring an initial resistance level based on the ability-related information. In some embodiments, at least one processor may additionally use artificial intelligence to determine an initial resistance level for a particular user.

By way of a non-limiting example, in FIG. 4, at least one processor may use the ability-related information to determine an initial resistance level for motorized resistance exercise machine 200 for particular user 232. For example, the at least one processor may set the initial resistance level at 50 lbs.

Some disclosed embodiments involve activating on a display, an initial graphical progress indicator depicting the initial resistance level and including an initial variable display region. Activating on a display may include rendering, refreshing, and/or changing settings of one or more pixels of the display. Depicting refers to conveying, presenting, communicating, and/or rendering, e.g., visually. A graphical progress indicator refers to a graphic element illustrating a degree of advancement and/or achievement. A graphical progress indicator including a variable display region refers to a graphic element having a portion that may change visually to convey a degree of progress of an exercise routine and/or set. For example, at least a portion of a graphical progress indicator may become darker, lighter, more transparent, more opaque, larger, smaller, brighter, and/or dimmer with each completed repetition. Additionally or alternatively, at least a portion of a graphical progress indicator may change color, texture, and/or position with each completed repetition. In some embodiments, a graphical progress indicator may include a counter tracking each completed repetition (e.g., counting up or down). As another example, a graphical progress indicator may include a fillable shape which may appear empty when an exercise set begins, progressively fills with each completed repetition, and appears full upon completion of a threshold number of repetitions (e.g., associated with an exercise set). As another example, a graphical progress indicator may include a moveable graphical element that begins at a start position when an exercise set begins, and progresses towards a finish position when the exercise set is completed. Activating a graphical progress indicator may include displaying the graphical progress indicator, and/or changing a visual characteristic of a displayed graphical progress indicator (e.g., by increasing the brightness, saturation, size, highlighting, causing the progress indicator to glow or pulse, or any other visual characteristic). In some embodiments, activating a graphical progress indicator may include updating an associated variable display region to reflect repetition completions. An initial graphical progress indicator depicting an initial resistance level refers to a graphical progress indicator element presenting the initial resistance level graphically. For example, an initial resistance level may be depicted using a specific color, shade, hue, transparency, opacity, saturation, position, size, shape, and/or any other visual characteristic indicating an initial resistance level. An initial graphical progress indicator may track repetitions performed at the initial resistance level. In some embodiments, an initial graphical progress indicator may be associated with an initial exercise set, and may visually change (e.g., fill) as repetitions for the initial exercise set are completed.

Figure 6:
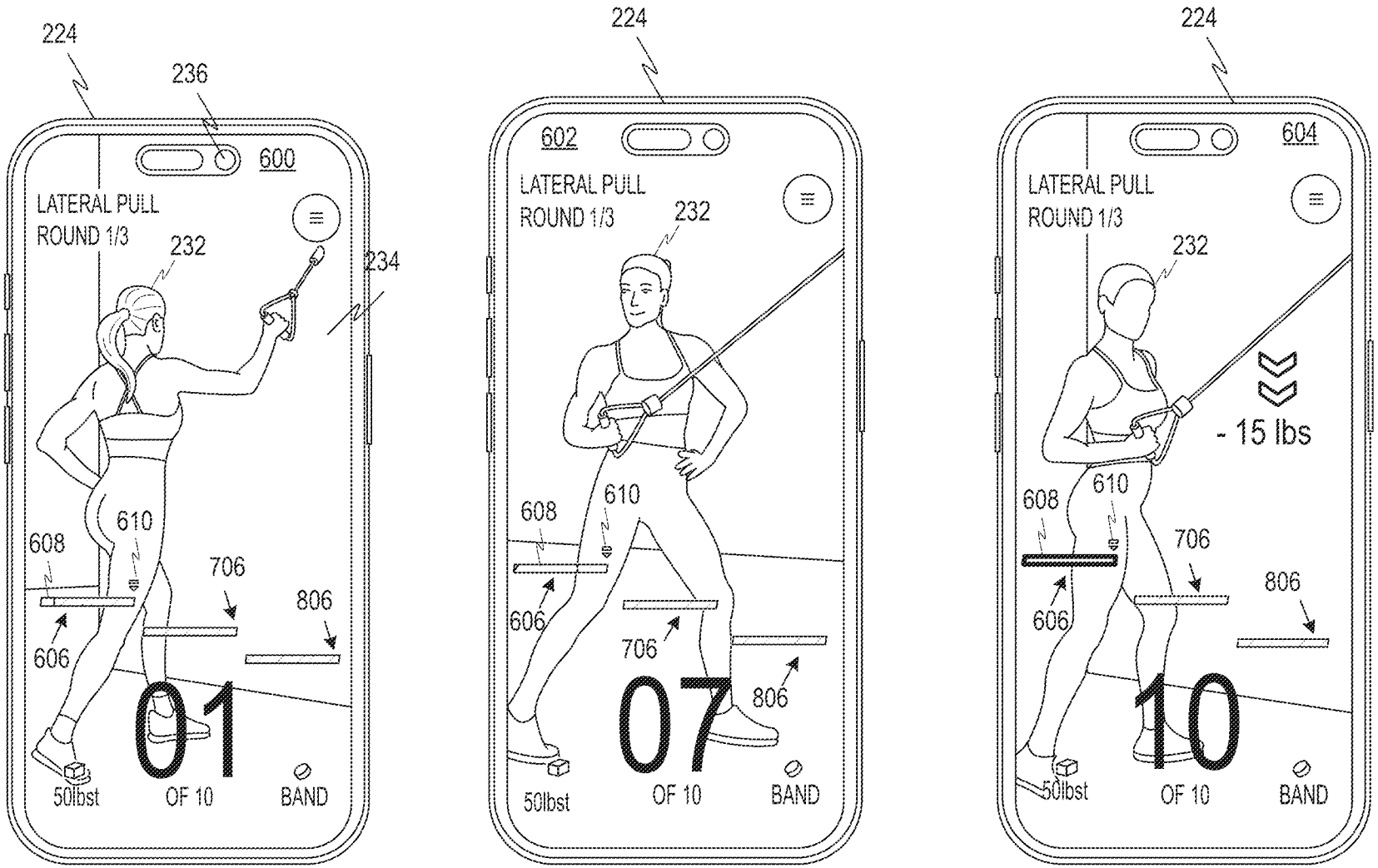
FIG. 6 is a series of front views of a mobile device display presenting an exemplary sequence of images of a video of the particular user performing a series of exercise repetitions using the motorized resistance exercise machine at an initial resistance level, consistent with some disclosed embodiments.

By way of a non-limiting example, reference is made to FIG. 6, which includes an exemplary sequence of images 600, 602, and 604 of a video of particular user 232 performing a series of exercise repetitions using exercise machine 200 at an initial resistance level, consistent with some disclosed embodiments. Images 600, 602, and 604 may be captured using camera 236 of mobile communications device 24), and may be displayed in real-time to particular user 232 on an electronic display (e.g., display 234 of mobile communications device 242 and/or a display of exercise machine 200). At least one processor (e.g., processor 102) may activate on the electronic display, an initial graphical progress indicator 606 depicting the initial resistance level (e.g., as a relative height and/or position within the electronic screen) and including an initial variable display region 608. In some embodiments, the activation may be presented to particular user 232 by an activation symbol 610, e.g., distinguishing initial graphical progress indicator 606 from non-activated indicators 706 and 806. A relative height for displaying progress indicator 606 may indicate an associated resistance level (e.g., indicators displayed higher may track exercise sets performed at higher resistance levels), and a distance from a left boundary of the display may indicate an order of an associated exercise set within a plurality of exercise sets included in a varying weight routine. Thus, initial graphical progress indicator 606 (e.g., for tracking the initial exercise set at the first and highest resistance level), may be displayed higher than subsequent graphical progress indicators, and furthest to the left. Initial graphical progress indicator 606 may be overlaid on images 600, 602, and 604.

Some disclosed embodiments involve adjusting power to a motor of the motorized resistance exercise machine to cause the motor to exert an initial resistance force corresponding to the initial resistance level. Power refers to the rate at which work is performed or energy is transferred from one form to another. Power (e.g., electric power) may refer to a rate at which electrical energy may be transferred by an electric circuit. Electric power may be measured in watts and may refer to a rate of electrical energy transferred by an electric circuit. Power may be calculated from a known voltage and/or current level (e.g., watts=volts× amps). A power signal refers to an electrical signal that carries energy or power. Power may flow from an energy source (e.g., an electrical grid and/or battery) as current to a motor and/or a voltage applied across windings of the motor via one or more electrical wires. The motor may convert electrical energy in the current and/or voltage to mechanical energy. Adjusting power to a motor of a motorized resistance exercise machine refers to changing an associated current and/or voltage delivered to a motor. Adjusting power to a motor may include modifying one or more characteristics of a power signal flowing to the motor, such increasing or decreasing an amplitude, a frequency, and/or shifting a phase of a power signal. Adjusting power to a motor may cause a corresponding adjustment to a force applied by the motor (e.g., increasing/decreasing power may increase/decrease a resistive force applied by the motor, respectively). A force refers to a push and/or pull applied to an object as a result of interaction with another object and may include at least a magnitude component and, in some instances, a direction component. A resistance force refers to a force for opposing another force. For example, a resistance motor of a motorized exercise machine may apply a force to resist a pulling motion by a user on an associated cable, and/or resist a pushing motion by a user on an associated paddle and/or pedal. An initial resistance force refers to a force applied by a resistance motor at the beginning of an exercise routine, e.g., for the first set of repetitions. An initial resistance force may be greater or less than one or more subsequent resistance forces applied during later periods of an exercise routine (e.g., during the middle or end of the exercise routine). An initial resistance force may be the highest or strongest resistance force applied during an exercise routine, the lowest or weakest resistance force applied during an exercise routine, or an intermediate force applied during an exercise routine (e.g., neither highest nor lowest). Causing a motor to exert an initial resistance force corresponding to an initial resistance level refers to controlling a motor to apply a resistance force at the beginning of an exercise routine, where the resistance force substantially matches an initial resistance level. In some instances, the corresponding initial resistance force may be somewhat less or more than the initial resistance level. Causation may occur through transmission of a signal to the resistance motor and/or to an associated control circuit to adjust a power signal delivered to the motor. In some embodiments, an associated control circuit may include a feedback loop and one or more associated sensors for stabilizing the initial resistance force. The adjustment to the power signal may cause a corresponding adjustment to a resistive force applied by the motor to resist forces applied by a user of the exercise machine. In some embodiments, causing a motor to exert an initial resistance force corresponding to an initial resistance level includes causing the motor to exert the initial resistance force at the initial resistance level for an initial exercise set of a plurality of exercise sets included in a varying weight routine.

In some disclosed embodiments, adjusting power to the motor includes altering at least one of a current or a voltage. Current refers to a flow of electrons through a conducting medium, and may be measured in Amperes (Amps, or A). Two ends of a conducting medium may be associated with a difference in electric potential, and current may flow from the end associated with the higher potential to the end associated with the lower potential. According to some conventions, the direction of a current flow may be defined as a flow of negatively charged particles from a source associated with a negative charge to a destination associated with a positive charge. According to other conventions, the direction of a current flow may be defined as originating from a positively charged source and flowing to a negatively charged destination. A voltage is a measure of electrical potential difference between two points. It may represent the force that drives electric charge to flow. A voltage may be associated with a tension between two points to reduce and/or eliminate an electrical potential difference therebetween. For example, the tension may be reduced by a current flowing from one point associated with a higher voltage level to another point associated with a lower voltage level point. Altering a current or a voltage refers to changing the current or voltage, e.g., by changing one or more of an amplitude, frequency, or phase of the current or voltage.

By way of a non-limiting example, in FIG. 3, at least one processor (e.g., processor 312) may adjust power to resistance motor 230 of motorized resistance exercise machine 200 (e.g., motorized resistance exercise machine) to cause motor 230 to exert an initial resistance force corresponding to the initial resistance level (e.g., 50 lbs). For example, the at least one processor may transmit signals to an associated controller) of resistance motor 230. In some embodiments, at least one processor may adjust power to the motor by at least one of altering at least one of a current or a voltage, e.g., by transmitting a control signal to an controller associated with the motor.

Some disclosed embodiments involve monitoring a plurality of initial resistance level repetitions, as the particular user exerts forces on the motor countering the initial resistance level. Exerting forces on a motor countering a resistance level refers to overcoming a resistance level applied by the motor by applying an opposing force. A particular user may exert a force on a motor, for example, by manipulating an accessory linked to the motor via a cable and/or rod. The force exerted by the particular user on the accessory may oppose a resistance force applied by the motor linked thereto. At the beginning an exercise routine, when the motor applies a resistance force at the initial resistance level, forces exerted by the particular user may counter the initial resistance level. For example, during an initial exercise set when starting an exercise routine, a motor may exert an initial resistance level corresponding to 100 pounds (lbs), or approximately 45 kilograms (kg). For each repetition of the initial exercise set, a user pulling on a pulley system linked to the motor may exert forces on the motor countering the 100 lbs resistance. Monitoring (as described above) a plurality of repetitions refers to tracking and/or recording characteristics of repetitions performed by the particular user while the motor exerts a resistance force. At least one processor may monitor the repetitions by receiving data from one or more sensors associated with a motor and/or an associated cable and/or rod. The data may be indicative of a resistance force applied by the resistance motor, and/or of motion by the resistance motor, an associated cable and/or rod, an accessory, and/or the particular user. The resistance force and/or motion may be sensed by a motion sensor, an image sensor, a voltage and/or current sensor, and/or any other type of sensor capable of detecting a resistance level and/or motion. The motion may be associated with the resistance motor, an associated cable and/or rod, an exercise accessory coupled thereto, and/or of the particular user. The at least one processor may use the sensed data to determine a resistance force applied by the motor corresponding to the initial resistance level. In addition, the at least one processor may analyze the data to measure a range of motion associated with an attempted repetition, determine based on the measured range of motion when an attempted repetition corresponds to a completed repetition, and/or increment a counter recording a number of completed repetitions. A range of motion associated with an attempted repetition refers to a full extent of movement performed when attempting an exercise repetition. A range of motion may be measured as an angle and/or distance. The at least one processor may increment the counter on condition that a range of motion for a repetition exceeds a range threshold, and/or that a duration for completing a repetition at the initial resistance level is less than a duration threshold. For example, a range threshold and/or duration threshold may include an absolute measurement (e.g., 40 centimeters and/or 1 second, respectively), and/or a relative measurement (e.g., at least 80% of an average historical range of motion and/or duration for the repetition type). Monitoring a plurality of initial resistance level repetitions refers to monitoring a plurality of repetitions while the resistance motor exerts a resistance force at the initial resistance level. This may include at least one processor using sensed data to confirm that a resistance force applied by the resistance motor corresponds to the initial resistance level, determining that a range of motion for a repetition performed at the initial resistance level exceeds a range threshold for the initial resistance level, determining that a duration for completing a repetition at the initial resistance level is less than a duration threshold for the initial resistance level, and/or incrementing a counter associated with the initial resistance level (e.g., and the initial exercise set) for each completed repetition. In some embodiments, a counter recording the number of completed repetitions at the initial resistance level may be associated with the first exercise set.

Some disclosed embodiments involve, upon detection of each of the plurality of initial resistance level repetitions, updating the initial variable display region to reflect initial resistance level repetition completions. Upon detection of each of the plurality of initial resistance level repetitions refers to after and/or based on detection (as described above) of each repetition at the initial resistance level, e.g., based on an analysis of sensor data associated with a motor and/or an associated cable and/or rod. Such sensor data may be received, for example, from a motion sensor, an optical sensor, an electrical (e.g., current and/or voltage) and/or magnetic sensor, and/or any other type of sensor capable of sensing exercise repetitions. At least one processor may receive the sensor data via one or more wired and/or wireless channels. Updating refers to revising, amending, and/or refreshing, e.g., based on current data. Updating an initial variable display region may include changing one or visual characteristics of the initial variable display region. For example, at least one processor may activate pixels of a visual display to change a color, shade, hue, transparency, opacity, saturation, position, size, shape, and/or any other visual characteristic of at least a portion of the initial variable display region. To reflect initial resistance level repetition completions refers to conveying and/or communicating how many repetitions have been completed at the initial resistance level. This may include changing at least one display characteristic of the initial variable display region such that the changed display characteristic conveys how many repetitions have been completed. For instance, at least one processor may change a display characteristic for a portion of the initial variable display region such that a ratio between the changed portion and the total initial variable display region corresponds to a ratio between a number of completed repetitions and a total number of repetitions needed to complete the initial exercise set. By way of example, if the initial exercise set performed at the initial resistance level includes ten repetitions, upon detecting two completed repetitions, at least one processor may cause one fifth (⅕ or 20%) of the initial variable display region to be filled, and upon detecting eight completed repetitions, at least one processor may cause fourth fifths (⅘ or 80%) of the initial variable display region to be filled.

By way of a non-limiting example, in FIG. 6, as particular user 232 exerts forces on motor 230 countering the initial resistance level (e.g., by pulling on cable 206 using an accessory 222, see FIG. 2), at least one processor (e.g., processor 102 in FIG. 1) may monitor a plurality of initial resistance level repetitions, e.g., using image data captured by mobile communications device 224 and/or mechanical sensor 324 detecting motion of cable 206. Upon detection of each of the plurality of initial resistance level repetitions, at least one processor may update initial variable display region 608 to reflect initial resistance level repetition completions. For instance, the at least one processor may incrementally change a color of variable display region 608 (e.g., from grey to white). In some embodiments, at least one processor may present resistance level completions numerically (e.g., as a running counter), and/or may present the initial resistance level on the display (e.g., 50 lbs).

Some disclosed embodiments involve detecting an initial motion stoppage during force exertion at the initial resistance level by the particular user. A motion stoppage refers to a pause and/or break within or between exercise repetitions. A motion stoppage may indicate a lack of movement by a resistance motor and/or an associated cable and/or rod due to a lack of motion (e.g., a pause) by the particular user. For instance, a motor and/or associated cable or rod of a motorized resistance exercise machine may move in response to a pulling and/or pushing motion by a user, and may be stationary when the user ceases the pulling and/or pushing motion. A motion stoppage may correspond to a respite from cardiovascular and/or muscle strain experienced by a user during a weight routine, e.g., for rest and/or recovery, and/or a structure interval separating differing exercise sets of a weight routine, and/or may separate differing exercise sets. Detecting a motion stoppage during force exertion at a resistance level by a particular user refers to discerning and/or identifying lack of motion by a resistance motor set to exert an exertion force corresponding to the resistance level, and/or lack of motion of an associated cable and/or rod, and or of the particular user. Detecting an initial motion stoppage during force exertion at the initial resistance level may include at least one processor receiving sensed data from one or more sensors, and using the sensed data to determine that a resistance force setting for the resistance motor corresponds to the initial resistance level, and/or that one or more of the resistance motor, the associated cable and/or rode and/or the user are stationary.

Some disclosed embodiments involve determining whether the initial motion stoppage at the initial resistance level exceeds an initial time threshold. A time threshold refers to a limit, boundary, floor, and/or ceiling for a time period. A time threshold may indicate a maximal or a minimal length and/or duration for a time window. An initial time threshold refers to a time threshold associated with the plurality of initial resistance level repetitions performed at the initial resistance level. At least one processor may determine an initial time threshold by accessing a schedule for the varying weight routine from memory, using the ability-related information about the particular user, and/or applying artificial intelligence to any of the above. Exceeding an initial time threshold refers to surpassing and/or extending beyond a time threshold associated with the initial resistance level. For example, an initial time threshold may indicate termination and/or completion of a first or initial exercise set of a variable weight routine scheduled for performance at the initial resistance level, prior to performance of one or more subsequent exercise sets scheduled for performance at differing (e.g., higher or lower) resistance levels. At least one processor may determine an initial time threshold by accessing a schedule for a varying weight routine from memory, using the ability-related information about the particular user, and/or applying artificial intelligence to any of the above. An initial time threshold may separate and/or delineate an initial exercise set from a subsequent exercise set of the varying weight routine. For example, a schedule for a varying weight routine may allocate twenty seconds to complete an initial exercise set of twenty repetitions at an initial resistance level (e.g., 80 lbs), followed by a rest period (e.g., an initial motion stoppage) of ten seconds, followed by another twenty seconds to complete a subsequent exercise of twenty repetitions at a resistance level other (e.g., higher or lower) than the initial resistance level (e.g., 70 lbs). Determining whether the initial motion stoppage at the initial resistance level exceeds an initial time threshold may include retrieving an initial time threshold from memory, setting a clock upon initial detection of the initial motion stoppage, monitoring the clock through continued detection of the initial motion stoppage, and continually comparing a state of the clock to the initial time threshold to identify when a duration of the initial motion stoppage is longer than the initial time threshold.

Some disclosed embodiments involve emitting audio when the initial time threshold is reached. Emitting audio refers to generating a sound via a speaker. Upon detecting that the initial motion stoppage has reached the initial time threshold, at least one processor may transmit a signal to cause a speaker to emit a sound. The sound may communicate to the particular user that the initial time threshold has been reached, and may prompt the particular user to begin a new set of repetitions (e.g., corresponding to a second exercise set).

By way of a non-limiting example, in FIGS. 2, 3, and 6, at least one processor (e.g., processor 102 in FIG. 1) may detect an initial motion stoppage during force exertion at the initial resistance level by particular user 232. For example, the at least one processor may receive signals over a time period from mechanical sensor 324 associated with cable 206 and/or motor 230, and/or from an image sensor of mobile communications device 224, and analyze the signals over the time period to determine lack of motion by cable 206 and/or motor 230. At least one processor may determine if the initial motion stoppage at the initial resistance level exceeds an initial time threshold (e.g., 2 seconds). In some embodiments, the stoppage detection need not be based on time. Other thresholds and/or criteria may be used as a stoppage indicator. For example, characteristic of cable motion, user data captured by the camera, or other sensors such as wearables (or non-wearables) may be used to determine stoppage. In some embodiments, at least one processor may cause emitting of audio signal when the initial time threshold is reached, e.g., by transmitting a signal to speaker 332 of exercise machine 200 and/or a speaker of mobile communications device 224. In some embodiments, upon detecting a completion of a predetermined number of repetitions at the initial resistance level (e.g., corresponding to the initial exercise set), the at least one processor may indicate the completion, e.g., by changing a display characteristic of graphical progress indicator 606 (e.g., from white to highlight yellow and/or by lowering the relative height).

Some disclosed embodiments involve, when the initial motion stoppage at the initial resistance level exceeds the initial time threshold, activating a first additional graphical progress indicator depicting a first reduced resistance level and including a first reduced variable display region. An initial motion stoppage at an initial resistance level exceeding an initial time threshold refers to the initial motion stoppage (as described above) being longer than the initial time threshold. Exceeding the initial time threshold may indicate completion of the initial exercise set and/or initiation of a subsequent exercise set, following the initial exercise set. A first reduced resistance level refers to a lesser and/or lower resistance level than the initial resistance level, following a first reduction in resistance. At least one processor may determine a first reduced resistance level by accessing a schedule for the varying weight routine from memory, using the ability-related information about the particular user, and/or applying artificial intelligence to the schedule and/or ability-related information. The at least one processor may translate the first reduced resistance level to a display characteristic for the first additional graphical progress indicator in a manner to convey the first reduction in resistance. The first reduction in the resistance level may be absolute (e.g., 10 lbs reduction), relative (e.g., 10% reduction), or any other manner of reduction. A first additional graphical progress indicator including a first reduced variable display region refers to another graphical progress indicator including a variable display region, in addition to the initial graphical progress indicator described above. In some embodiments, the first additional graphical progress indicator including the first reduced variable display region may have a substantially similar appearance as the initial graphical progress indicator including the initial variable display region. In some embodiments, a first additional graphical progress indicator may be associated with a second exercise set, and may visually change (e.g., fill) as repetitions for the second exercise set are completed. Activating a first additional graphical progress indicator may include causing the first additional graphical progress indicator to be visible, or changing one or more visual characteristics of the first additional graphical progress indicator to improve visibility thereof and/or draw focus thereto, e.g., by increasing a brightness, saturation, intensity, opacity, size, and/or changing a color of pixels associated with the first additional graphical progress indicator. Depicting a first reduced resistance level refers to portraying and/or representing a resistance level lower than the initial resistance level. The first additional graphical progress indicator may track repetitions performed at the first reduced resistance level, and may be displayed in a manner indicating a reduction in resistance. For example, the first additional graphical progress indicator may be displayed below the initial graphical progress indicator, and/or using a different color, saturation, brightness, transparency, opacity, size, and/or any other visual characteristic indicative of a reduction in resistance.

Figure 7:
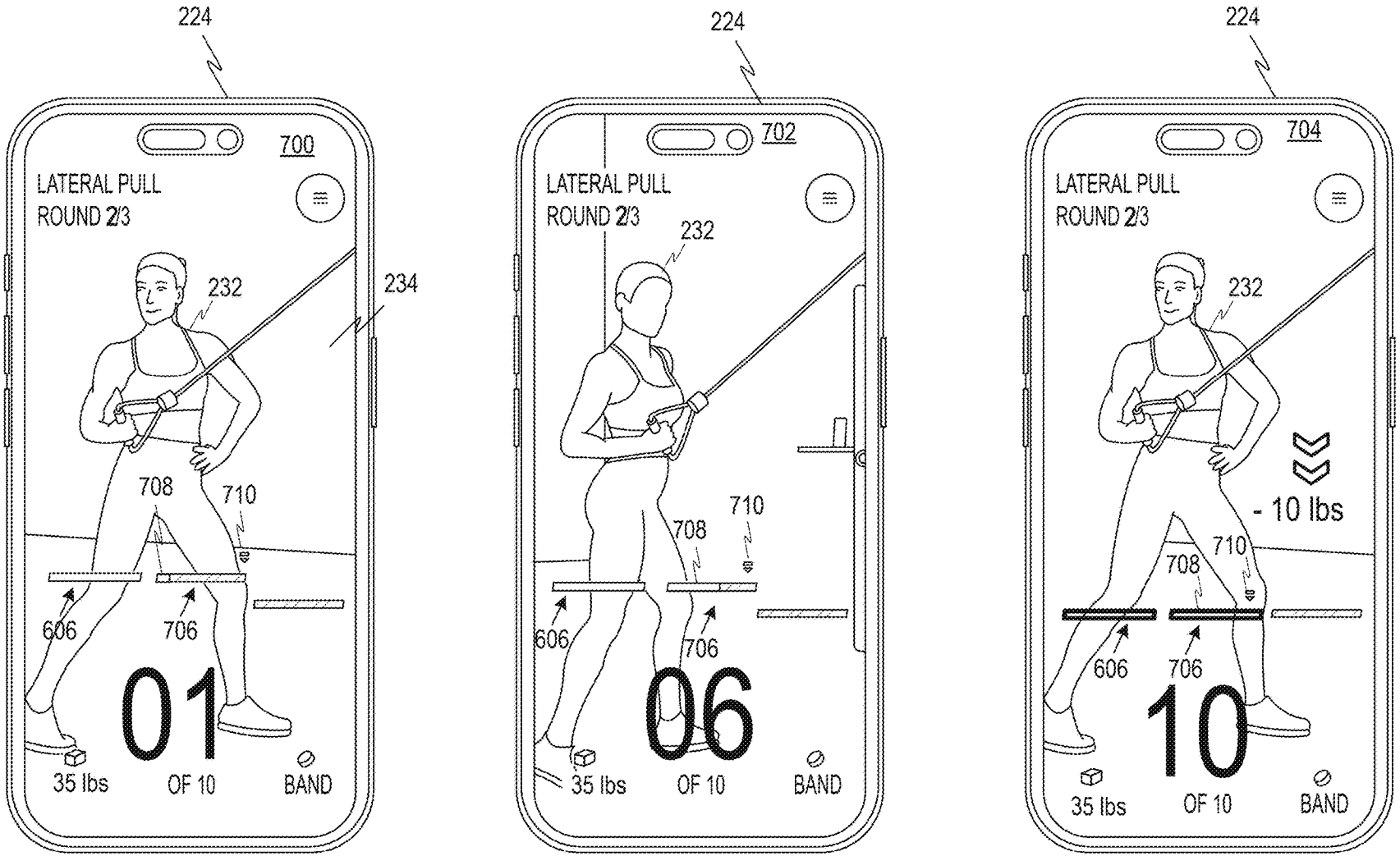
FIG. 7 is a series of front views of a mobile device display presenting an exemplary sequence of images of a video of a user performing a series of exercise repetitions using the motorized resistance exercise machine at a first reduced resistance level, consistent with some disclosed embodiments.

By way of a nonlimiting example, reference is made to FIG. 7 which includes an exemplary sequence of images 700, 702, and 704 of a video of particular user 232 performing a series of exercise repetitions using motorized resistance exercise machine 200 at a first reduced resistance level, consistent with some disclosed embodiments. When the initial motion stoppage at the initial resistance level exceeds the initial time threshold (e.g., at least 2 seconds), at least one processor (e.g., processor 102 in FIG. 1) may activate a first additional graphical progress indicator 706 depicting a first reduced resistance level and including a first reduced variable display region 708. For instance, first additional graphical progress indicator 706 may be displayed to the side (e.g., right) and lower than initial graphical progress indicator 606. In some embodiments, at least one processor may display the first reduced resistance level (e.g., 35 lbs). Activation may include displaying first additional graphical progress indicator 706 and/or changing a display characteristic of first additional graphical progress indicator 706 to improve visibility and/or draw focus. In some embodiments, the activation may be presented to particular user 232 by an activation symbol 710, e.g., distinguishing first additional graphical progress indicator 706 from non-activated indicators 606 and 806.

Some disclosed embodiments involve altering an electrical characteristic applied to the motor to cause the motor to exert a first reduced resistance force less than the initial resistance force. Altering an electrical characteristic applied to a motor refers to altering (as described above) an attribute and/or property of an electrical signal, thereby affecting the operation of the motor. This may include, for example, altering a characteristic of power delivered to the motor, e.g., by altering a current, voltage, resistance, load, frequency, phase, timing, on/off state, and/or any other characteristic of power. This may additionally include transmitting a control signal to an associated controller and/or control circuit for altering an electrical characteristic applied to the motor. For example, reducing a current and/or voltage, and/or increasing a load on the motor may reduce a resistance force applied by the motor. A first reduced resistance force less than the initial resistance refers to a resistance force outputted by the motor (e.g., following the initial motion stoppage exceeding the initial time threshold) that is weaker and/or lower than the initial resistance level. For instance, a second exercise set (following and separated from the initial exercise set by the initial motion stoppage) may be scheduled for performance at a lower resistance level than the initial resistance level, permitting the particular user to apply less force to counter the resistance by the motor. To cause the motor to exert a first reduced resistance force refers to control, operate, and/or drive the motor to output the first reduced resistance force. For example, after completion of the initial exercise set (e.g., indicated by the initial motion stoppage exceeding the initial time threshold), at least one processor may transmit a signal to a control circuit to increase a load imposed on the motor and/or reduce an amplitude of a power signal delivered to the motor, such that the first reduced resistance force outputted by the motor is less than the initial resistance force.

By way of a non-limiting example, in FIG. 3, at least one processor 312 of control circuit 300 may alter electrical characteristic applied to motor 230 to cause motor 230 to exert a first reduced resistance force, less than the initial resistance force. For instance, at least one processor may transmit signals for lowering the first reduced resistance level to 35 lbs., e.g., from 50 lbs.

Some disclosed embodiments involve, as the particular user exerts forces on the motor, countering the first reduced resistance level, monitoring a plurality of first reduced resistance level repetitions. Monitoring a plurality of first reduced resistance level repetitions as a particular user exerts forces on a motor countering the first reduced resistance level may be understood as described above for the plurality of initial resistance level repetitions at the initial resistance level. At least one processor may track and/or record characteristics of repetitions performed by the particular user while the motor exerts a resistance force at the first reduced resistance level. This may include at least one processor using sensed data to confirm that a resistance force applied by the resistance motor corresponds to the first reduced resistance level, determine that a range of motion for a repetition performed at the first reduced resistance level exceeds a range threshold for the first reduced resistance level, determine that a duration for completing a repetition at the first reduced resistance level is less than a duration threshold for the first reduced resistance level, and/or increment a counter associated with the first reduced resistance level (e.g., and the second exercise set) for each completed repetition. In some embodiments, a counter recording the number of completed repetitions at the first reduced resistance level may be associated with the second exercise set.

Some disclosed embodiments involve, upon detection of each of the plurality of first reduced resistance level repetitions, updating the first reduced variable display region to reflect first reduced repetition completions. Updating a first reduced variable display region to reflect first reduced repetition completions upon detection of each of the first reduced resistance level repetitions may be understood as described above for the initial variable display region reflecting the initial resistance level repetition completions. For instance, at least one processor may change a display characteristic for at least a portion of the first reduced variable display region such that a ratio between the changed portion and the total first reduced variable display region reflects a ratio between a number of completed repetitions and a total number of repetitions needed to complete the second exercise set. By way of example, if the plurality of first reduced level repetitions (e.g., the second exercise set) includes ten repetitions, upon detecting four completed repetitions, at least one processor may cause two fifths (⅖ or 40%) of the first reduced variable display region to be filled, and upon detecting nine completed repetitions, at least one processor may cause nine tenths (9/10 or 90%) of the first reduced variable display region to be filled.

Some disclosed embodiments involve detecting a first motion stoppage during force exertion at the first reduced resistance level by the particular user. Detecting a first motion stoppage during force exertion at the first reduced resistance level by the particular user may be understood as describe above for the initial motion stoppage. At least one processor may receive sensed data from one or more sensors, and may use the sensed data to determine that a resistance force setting for the resistance motor corresponds to the first reduced resistance level, and that one or more of the resistance motor, the associated cable and/or rode and/or the user are stationary.

Some disclosed embodiments involve determining whether the first motion stoppage exceeds a first time threshold. A first time threshold refers to a time threshold, as described earlier. The first time threshold may be associated, for example, with the plurality of first reduced resistance level repetitions performed at the first reduced resistance level. Determining whether the first motion stoppage exceeds a first time threshold may be understood as described above for the initial motion stoppage. At least one processor may determine the first time threshold by accessing a schedule for a varying weight routine from memory, using the ability-related information about the particular user, and/or applying artificial intelligence to any of the above.

In some disclosed embodiments, the initial time threshold for the initial resistance level and the first time threshold for the first reduced resistance level are equal. Equal refers to substantially the same and/or equivalent. For example, the initial time threshold and the first time threshold may each be ten seconds, providing the particular user with a reprieve of ten seconds between the initial exercise set and the second exercise set, and another reprieve of ten seconds between the second exercise set and a third exercise set. In some disclosed embodiments, the initial time threshold for the initial resistance level and the first time threshold for the first reduced resistance level differ. Differ refers to dissimilar and/or distinguishable. The initial time threshold may be longer or shorter than the first time threshold. For example, the initial time threshold may be ten seconds and the first time threshold may be fifteen seconds, providing the particular user with a reprieve of ten seconds between the initial exercise set and the second exercise set, and another reprieve of fifteen seconds between the second exercise set and a third exercise set.

By way of a non-limiting example, in FIGS. 4 and 7, as particular user 232 exerts forces on motor 230 countering the first reduced resistance level (e.g., by pulling on cable 206 of motorized resistance exercise machine 200 to pull 35 lbs. instead of 50 lbs.), at least one processor (e.g., processor 102) may monitor a plurality of first reduced resistance level repetitions. Upon detection of each of the plurality of first reduced resistance level repetitions, at least one processor may update first reduced variable display region 708 to reflect first reduced repetition completions. For instance, with each completed repetition, the at least one processor may incrementally change the color of first reduced variable display region 708 of first additional graphical progress indicator 706 from grey to white, such that a ratio of the white vs grey portions of first reduced variable display region 708 reflects a ratio of completed repetitions from a total number of repetitions determined the first reduced resistance level (e.g., the second exercise set). At least one processor may detect a first motion stoppage during force exertion at the first reduced resistance level by particular user 232, e.g., based on sensor data associated with cable 206, motor 230 and/or particular user 232, and may determine if the first motion stoppage at the exceeds a first time threshold (e.g., 3 seconds). In some embodiments, upon detecting a completion of a predetermined number of repetitions at the first reduced resistance level (e.g., corresponding to the second exercise set), the at least one processor may indicate the completion, e.g., by changing a display characteristic of first additional graphical progress indicator 706 (e.g., from white to highlight yellow and/or by lowering the relative height).

Some disclosed embodiments involve, when the first motion stoppage exceeds the first time threshold: activating a second additional graphical progress indicator depicting a second reduced resistance level and including a second reduced variable display region. Activating a second additional graphical progress indicator depicting a second reduced resistance level and including a second reduced variable display region when the first motion stoppage exceeds the first time threshold may be understood as described when the initial motion stoppage exceeds the initial time threshold. A second reduced resistance level refers to a lesser and/or lower resistance level than the first reduced resistance level, following a further (e.g., second) reduction in resistance. A second additional graphical progress indicator including a second reduced variable display region refers to another additional graphical progress indicator including a variable display region, in addition to the initial graphical progress indicator and the first additional graphical progress indicator described above. The second additional graphical progress indicator including the second reduced variable display region may have a substantially similar appearance as the initial graphical progress indicator and the first additional graphical progress indicator. A second additional graphical progress indicator may be associated with a third exercise set, and may visually change (e.g., fill) as repetitions for the third exercise set are completed. Thus, the resistance applied by the motor may decrease as the variable weight routine progresses. At least one processor may indicate each reduction in the resistance level graphically. For example, the second additional graphical progress indicator may be displayed below the first additional graphical progress indicator, and/or using a different color, saturation, brightness, transparency, opacity, size, and/or any other visual characteristic indicative of a further reduction in resistance.

In some embodiments, the initial graphical progress indicator depicting the initial resistance level may be associated with an initial exercise set including multiple repetitions performed while the resistance motor applies resistance at the initial resistance level, the first additional graphical progress indicator depicting the first reduced resistance level may be associated with a second exercise set including multiple repetitions performed while the resistance motor applies resistance at the first reduced resistance level, and the second additional graphical progress indicator depicting the second reduced resistance level may be associated with a third exercise set including multiple repetitions performed while the resistance motor applies resistance at the second reduced resistance level For example, the initial exercise set may include fifteen repetitions at a resistance level of 100 lbs (the initial resistance level), the second exercise set, following the initial motion stoppage, may include fifteen repetitions at 80 lbs (the first reduced resistance level), and the third exercise set, following the first motion stoppage may include fifteen repetitions at 60 lbs (e.g., the second reduced resistance level). At least one processor may graphically track progress of the initial, second, and third exercise sets by progressively changing the associated variable display regions for the initial graphical progress indicator, the first additional graphical progress indicator and the second additional graphical progress indicator with each completed repetition.

Some disclosed embodiments involve using the ability-related information to determine the first reduced resistance level and the second reduced resistance level. This may be understood to mean applying information in the ability-related information to assess the first and second reduced resistance levels. The ability-related information may include explicit levels and/or reductions for the first and second reduced resistance levels, past performances of similar varying weight routines, user preferences, and/or any other information that may be used to determine the first and second reduced resistance levels. In some embodiments, at least one processor may apply a predictive model and/or artificial intelligence to the ability-related information to determine the first and second reduced resistance levels.

Figure 8:
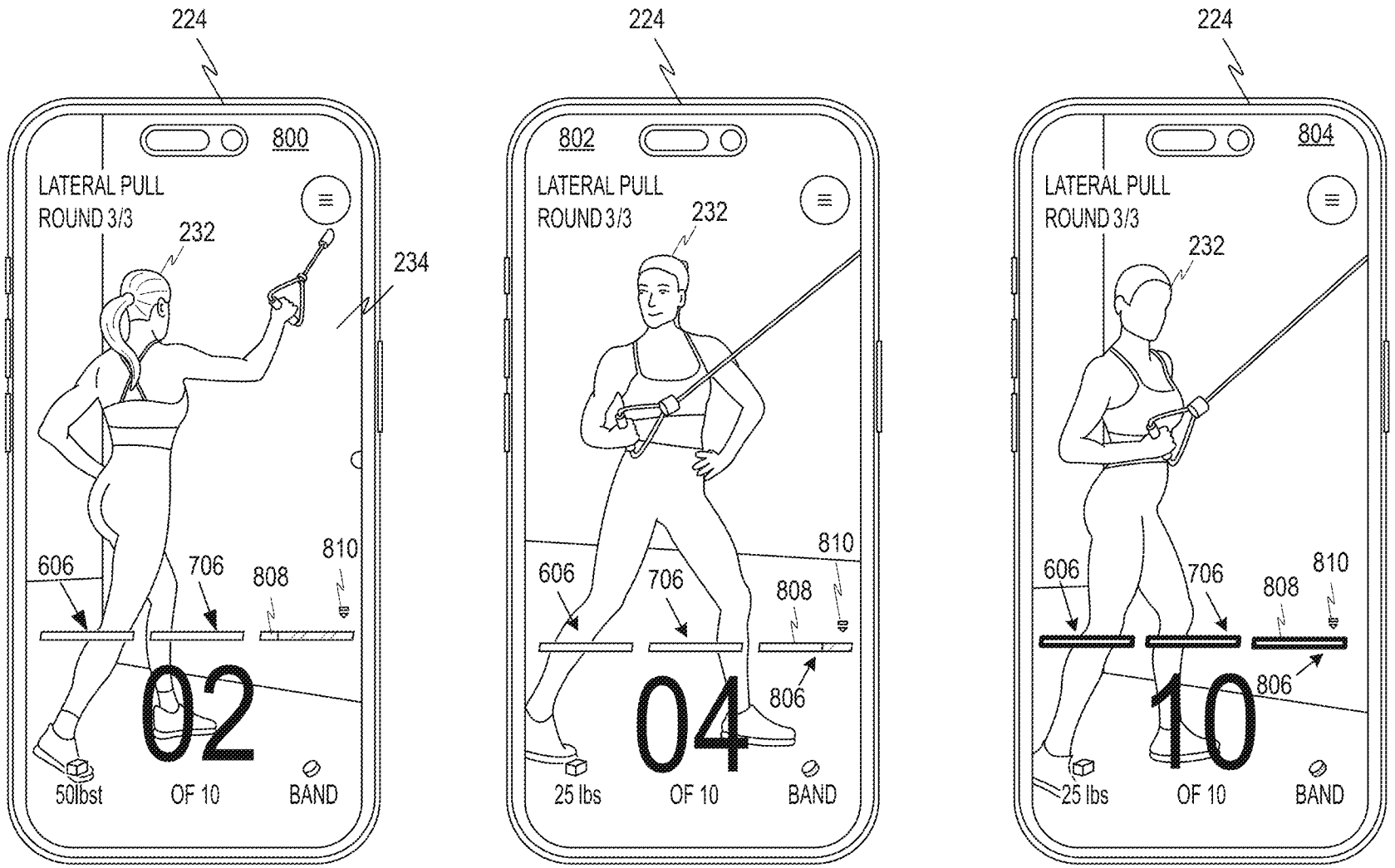
FIG. 8 is a series of front views of a mobile device display presenting an exemplary sequence of images of a video of a user performing a series of exercise repetitions using the motorized resistance exercise machine at a second reduced resistance level, consistent with some disclosed embodiments.

By way of a nonlimiting example, reference is made to FIG. 8, which includes an exemplary sequence of images 800, 802, and 804 of a video of particular user 232 performing a series of exercise repetitions using motorized resistance exercise machine 200 at a second reduced resistance level, consistent with some disclosed embodiments. When the first motion stoppage exceeds the first time threshold (e.g., at least 3 seconds), at least one processor (e.g., processor 102) may activate a second additional graphical progress indicator 806 depicting a second reduced resistance level and including a second reduced variable display region 808. For instance, second additional graphical progress indicator 806 indicator may be displayed to the right of first additional graphical progress indicator 706 and initial graphical progress indicator 606, and lower than the where first additional graphical progress indicator 706 was displayed during performance of the first reduced resistance level repetitions. In some embodiments, the activation may be presented to particular user 232 by an activation symbol 810, e.g., distinguishing second additional graphical progress indicator 806 from non-activated indicators 606 and 706.

Some disclosed embodiments involve altering the electrical characteristic applied to the motor to cause the motor to exert a second reduced resistance force less than the first reduced resistance force. Altering the electrical characteristic applied to the motor to cause the motor to exert a second reduced resistance force less than the first reduced resistance force may be understood as described above for the initial resistance level and the first reduced resistance level. For example, at least one processor may transmit a control signal to an associated controller and/or control circuit to alter an electrical characteristic applied to the motor, e.g., and thereby further reduce a current and/or voltage, and/or further increase a load on the motor.

By way of a non-limiting example, in FIG. 3, at least one processor 312 may alter the electrical characteristic applied to motor 230 to cause motor 230 to exert a second reduced resistance force less than the first reduced resistance force. For instance, at least one processor 312 may transmit signals to an associated controller to lower the first reduced resistance level (e.g., 35 lbs.) exerted by motor 230 to 25 lbs. In some embodiments, at least one processor 312 may present the second reduced resistance force on the display (e.g., of mobile communications device 224).

In FIG. 8, in some embodiments, as particular user 232 exerts forces on motor 230 countering the second reduced resistance level, at least one processor may monitor a plurality of second reduced resistance level repetitions. Upon detection of each second reduced resistance level repetition, at least one processor may update second reduced variable display region 808, e.g., by incrementally changing the color from grey to white.

In some disclosed embodiments, the initial graphical progress indicator, the first additional graphical progress indicator, and the second additional graphical progress indicator each include an associated progress bar for indicating successive repetitions. A progress bar refers to an elongated visual element indicating advancement of a task and/or process. A progress bar may visually represent how much of a task and/or process has been completed and how much remains. In some embodiments, a progress bar may be a fillable shape that progressively fills to match progress for completing a task. For example, at least one processor may display a first progress bar for tracking completions of the plurality of initial resistance level repetitions (e.g., included in an initial exercise set), a second progress for tracking completions of the plurality of first reduced resistance level repetitions (e.g., included in a second exercise set), and a third progress bar for tracking completion of a plurality of second reduced resistance level repetitions (e.g., included in a third exercise set).

In some disclosed embodiments, the plurality of associated progress bars are arranged as steps. Arranging a plurality of associated progress bars as steps refers to positioning, placing, and/or aligning the progress bars in a staggered and/or tiered manner, such that successive progress bars are displayed at progressively increasing or decreasing levels. For example, each subsequent progress bar may be indented more than a prior progress bar (e.g., to the right, to the left, top, or bottom margins of a display region and/or graphical user interface or GUI of an electronic display). The progress bars may be separated by gaps and may mimic stairs.

In some disclosed embodiments, each successive step is presented at an elevation lower than a prior step, thereby visually presenting the initial resistance level, the first reduced resistance level, and the second reduced resistance level. A successive step refers to a subsequent and/or follow-up step. A prior step refers to a previous and/or earlier step. Presenting each successive step at an elevation lower than a prior step may include displaying a successive step on a visual display below a display of a prior step such that the successive step is below the prior step relative to upper and/or lower margins of a display region and/or GUI of an electronic screen. For example, at least one processor may display an initial progress bar at a first level on a visual display for tracking repetitions at the initial resistance level, display a first successive progress bar on the visual display at a second level below the first level for tracking repetitions at the first reduced resistance level, and display a second successive progress bar on the visual display at a third level below the second level for tracking repetitions at the second reduced resistance level. The level on the visual display for each progress bar may indicate the resistance level applied by the motor during repetitions tracked using each progress bar.

In some disclosed embodiments, the initial graphical progress indicator, the first additional graphical progress indicator, and the second additional graphical progress indicator each include an accumulative region populated in response to detection of successive repetitions. An accumulative region populated in response to detection of successive repetitions refers to a fillable or growable graphical element for indicating an aggregation, incremental, and/or additive number of repetitions. An accumulative region may fill or grow in an incremental manner to indicate each completed repetition, e.g., using a progressively changing visual characteristic, such as a color, texture, brightness, saturation, opacity, and/or progressively change in color. For example, each accumulative region for each of the initial graphical progress indicator, the first additional graphical progress indicator, and the second additional graphical progress indicator may become progressively darker, brighter, or more opaque with each completed repetition.

In some disclosed embodiments, each of the accumulative regions are sized to correspond to a predetermined number of repetitions. A predetermined number of repetitions refers to a predefine and/or prestored number of repetitions. For example, the initial graphical progress indicator may track progress of an initial exercise set, the first additional graphical progress indicator may track progress of a second exercise set, and the second additional graphical progress indicator may track progress of a third exercise set. Each of the first, second, and third exercise sets may be associated with a predetermined and/or recommended number of repetitions for completion. Each exercise set may include the same predetermined number of repetitions, or increasing or decreasing predetermined number of repetitions. At least one processor may obtain the predetermined number of repetitions for each exercise set by accessing a schedule for a varying weight routine from memory, using the ability-related information about the particular user, and/or applying artificial intelligence to any of the above. An accumulate region sized to correspond to a predetermined number of repetitions refers to determining dimensions for an accumulative region to represent an associated predetermined number of repetitions for completion at each of the resistance levels. For example, if the initial exercise set performed at the initial resistance level includes ten repetitions, the second exercise set performed at the first reduced resistance level includes fifteen repetitions, and the third exercise set performed at the second reduced resistance level includes twenty repetitions, an accumulative region tracking the first exercise set may be two thirds (⅔) the size of an accumulative region tracking the second exercise set, and half the size of an accumulative region tracking the third exercise set.

In some disclosed embodiments, after the predetermined number of repetitions are detected the operations further include presenting on the display an overage indicator. An overage indicator refers to a graphical representation that a number of completed repetitions exceeds a predetermined and/or recommended number of repetitions. An overage indicator may include a change in a display characteristic, such as by causing a progress bar to glow, flash, and/or enlarge, and/or otherwise enhancing the display of the progress bar. In some embodiments, an overage indicator may include a display of a numerical counter. Returning to the example above, at least one processor may present an overage indicator upon detecting that the particular user has completed ten repetitions at the initial resistance level and has begun an eleventh repetition without stopping, e.g., by causing the progress bar to flash and/or by displaying "11 of 10" in proximity to the progress bar.

By way of a non-limiting example, in FIGS. 6-8, initial graphical progress indicator 606, the first additional graphical progress indicator 706, and second additional graphical progress indicator 808 may each include an associated progress bar for indicating successive repetitions. For instance, the progress bars may be initially displayed grey, and may be incrementally filled with white in response to each detected repetition at the associated resistance level. By way of a non-limiting example, in FIG. 6, the plurality of progress bars (e.g., initial graphical progress indicator 606, the first additional graphical progress indicator 706, and second additional graphical progress indicator 808) may be arranged as steps. In some disclosed embodiments, each successive step may be presented at an elevation lower (e.g., closer to the lower display margin) than a prior step, thereby visually presenting the initial resistance level, the first reduced resistance level, and the second reduced resistance level. For instance, initial graphical progress indicator 606 may be displayed higher than first additional graphical progress indicator 706, which may be displayed higher than second additional graphical progress indicator 808. In some disclosed embodiments, upon completion of a plurality of repetitions at a particular resistance level, at least one processor may indicate the completion by displaying the associated graphical progress indicator at the same elevation as a subsequent graphical progress indicator. For instance, upon completing the initial exercise set (e.g., 10 repetitions), initial graphical progress indicator 606 may be lowered such that progress indicator 606 is displayed at the same height as first additional graphical progress indicator 706. In some embodiments, upon completing the initial exercise set (e.g., when the initial motion stoppage exceeds the initial time threshold), at least one processor may display a drop in resistance for performing the second exercise set (e.g., −15 lbs, such that if resistance motor 230 exerted 50 lbs of resistance during the initial exercise set, resistance motor 230 may exert 35 lbs of resistance during the second exercise set).

Similarly, upon completing next exercise set (e.g., 10 repetitions), initial graphical progress indicator 606 and first additional graphical progress indicator 706 may be lowered to be displayed at the same height as second additional graphical progress indicator 806. In some embodiments, each of accumulative regions 608, 708, and 808 may be sized to correspond to a predetermined number of repetitions (e.g., 10 repetitions per exercise set). In some embodiments, upon completing the second exercise set (e.g., when the first motion stoppage exceeds the first time threshold), at least one processor may display another drop in resistance for performing the third exercise set (e.g., −10 bs, such that if resistance motor 230 exerted 35 lbs of resistance during the second exercise set, resistance motor 230 may exert 25 lbs of resistance during the third exercise set).

In some disclosed embodiments, during successive repetitions following display of the overage indicator, an associated accumulative region remains unchanged. Unchanged refers to the same, unvarying, fixed, and/or a substantially persistent magnitude even if the graphical elements reflecting the persistent magnitude change. Successive repetitions following display of the overage indicator refers to additional repetitions after the overage indicator has been presented. The additional repetitions may be performed without the user pausing (e.g., absent a stoppage), and therefore they may be performed at the same resistance level as the repetitions performed prior to display of the overage indicator. For instance, each stoppage may indicate to at least one processor termination of an exercise set at a specific resistance level, and may trigger alteration of electrical characteristics applied to the motor to initiate a new exercise set at a lower resistance level. Once the user completes a predetermined number of repetitions for a particular exercise set, at least one processor may populate the entire accumulative region. If the user continues to perform additional repetitions beyond the predetermined number, without pausing, the at least one processor may attribute the additional repetitions to the particular exercise set. The at least one processor may indicate the additional repetitions using the overage indicator and may leave the accumulative region unchanged.

Figure 9:
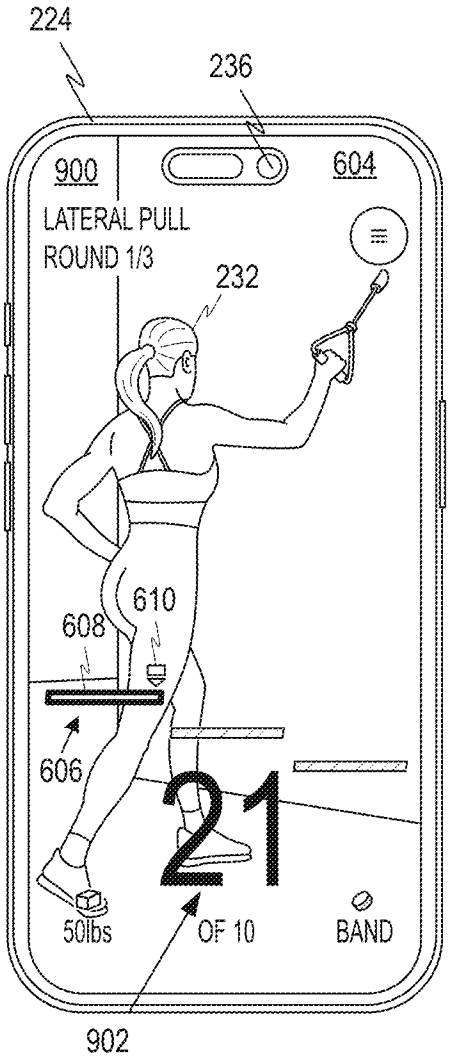
FIG. 9 is a front view of a mobile device display depicting an exemplary image of a user performing a series of exercise repetitions exceeding a predetermine number, indicated by an overage indicator, consistent with some disclosed embodiments.

By way of a non-limiting example, reference is made to FIG. 9 presents an exemplary image 900 of particular user 232 performing a series of exercise repetitions exceeding a predetermined number, indicated by an overage indicator 902, consistent with some disclosed embodiments. Camera 236 included in mobile communications device 224 may capture image 900 after capturing images 600, 602, and 604 in FIG. 6. After the predetermined number of repetitions are detected, at least one processor may present on the display an overage indicator. For example, overage indicator 902 may include a running counter (e.g., 21 of 10). In some embodiments activation symbol 610 may increase in size and/or brightness with each repetition above the predetermined number. In some embodiments, during successive repetitions following display of overage indicator 902 and/or 904, accumulative region 608 may remain unchanged.

In some disclosed embodiments, the display of the initial graphical progress indicator, the first additional graphical progress indicator, and the second additional graphical progress indicator are caused to be presented on a mobile communications device paired to the motorized resistance exercise machine. Pairing may involve establishment of a wired or wireless communications channel between two or more devices for enabling bidirectional data transfer. Pairing two devices may involve implementation of a discovery stage and a connection protocol. In some instances, pairing two devices together may include implementation of an authentication protocol. Some technologies for enabling pairing of two or more devices include Bluetooth and Near Fields Communication NFC) technology. For example, a user may pair a mobile communications device (as described elsewhere herein) with at least one processor associated with a piece of exercise equipment (e.g., an exercise machine) during performance of physical exercise repetitions. The mobile communications device may receive signals from the paired processor indicative of exercise machine movement repetitions, process the signals, and present a gamified user interface for regulating (e.g., pacing) the user's physical exercise repetitions. Pairing a mobile communications device to a motorized resistance exercise machine may permit synchronizing a display of content via the mobile communications device with progress of a varying weight routine. At least one processor may transmit data for displaying the initial graphical progress indicator, the first additional graphical progress indicator, and the second additional graphical progress indicator to the mobile communications device, permitting an associated processor to render the progress indicators on a display of the mobile device. In some embodiments, at least some content displayed on a user interface of the motorized resistance exercise machine may be mirrored on a screen of the paired mobile communications device, such as a resistance level, a mode, a number of repetitions and/or any other information. In some embodiments, at least some content displayed on a screen of the mobile communications device may be mirrored on the user interface of the motorized resistance exercise machine paired thereto. In some embodiments, the motorized resistance exercise machine may include a dial for adjusting a resistance level, mode, and/or additional settings, and a face of the dial may include a user interface. When a user uses the dial to change setting of the motorized resistance exercise machine, the changes may be displayed on the user interface of the dial and on the mobile communications device paired thereto. When a user uses the mobile communications device to change setting of the motorized resistance exercise machine, the changes may be displayed on the user interface of the dial and on the mobile communications device paired thereto.

Figure 10:
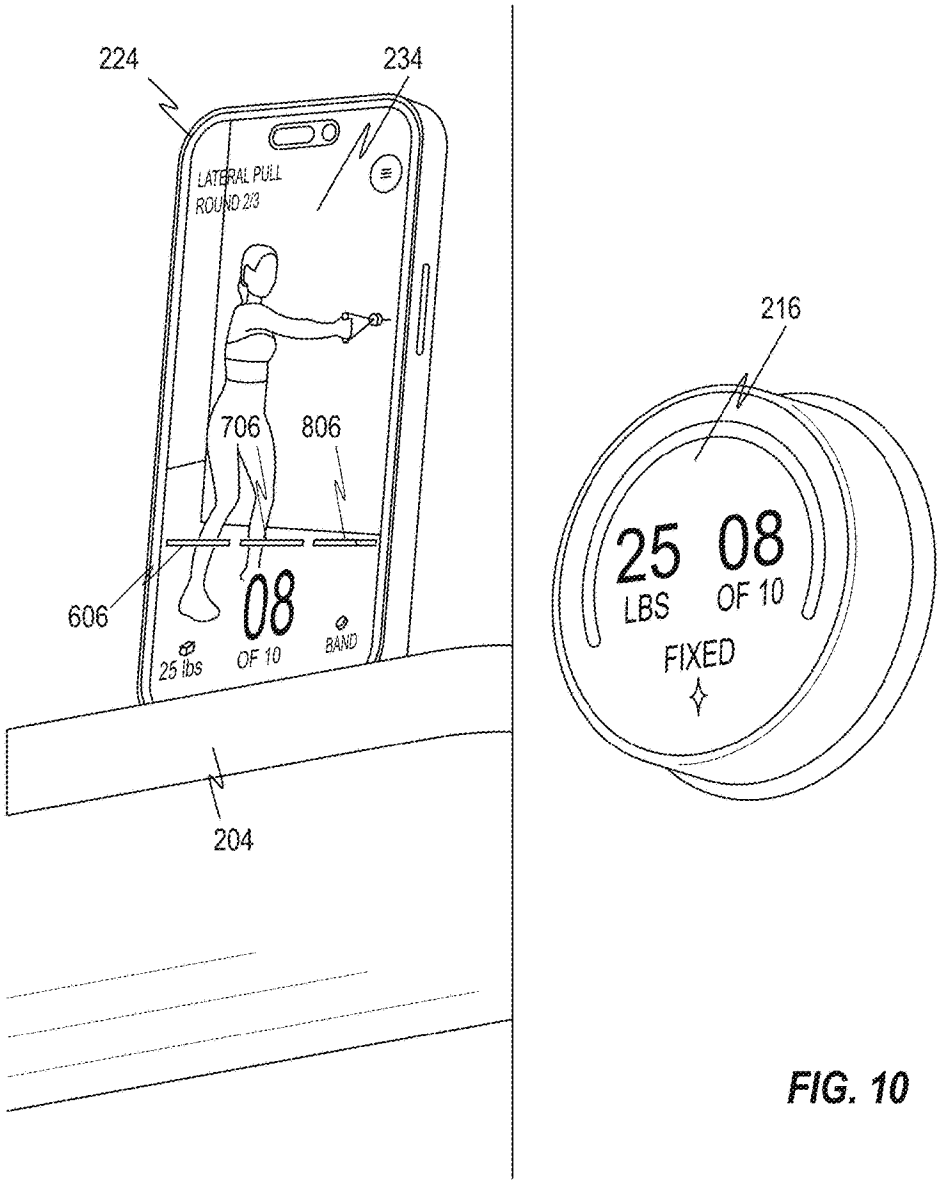
FIG. 10 a perspective view of a portion of an exemplary motorized resistance exercise machine and a paired mobile communications device consistent with some disclosed embodiments.

By way of a non-limiting example, reference is made to FIG. 10 depicting progress of a variable weight routine performed by user 232, consistent with some disclosed embodiments. At least one processor (e.g., processor 102) may present initial graphical progress indicator 606, first additional graphical progress indicator 706, and second additional graphical progress indicator 806 (see FIGS. 6-9) on mobile communications device 224 paired to motorized resistance exercise machine 200. In some embodiments, portions displayed on mobile communications device 224 may be additionally displayed on a user interface of motorized resistance exercise machine 200 (e.g., via dial 216), such as a resistance level (e.g., 25 lbs) and/or a number of completed repetitions, reflecting synchronization between mobile communications device 224 and motorized resistance exercise machine 200 due to the pairing.

Some disclosed embodiments involve simultaneously displaying the initial graphical progress indicator, the first additional progress indicator, and the second additional progress indicator. Simultaneously refers to concurrently, and/or substantially at the same time. At least one processor may display all three indicators (e.g., the initial graphical progress indicator, the first additional progress indicator, and the second additional progress) at the same time, e.g., when initiating the varying weight routine.

In some disclosed embodiments, the initial graphical progress indicator, the first additional progress indicator, and the second additional progress indicator are simultaneously displayed in response to receiving the prompt, prior to activation of the initial graphical progress indicator on the display. In response to receiving a prompt refers to consequent to detecting the prompt. Prior to activation of the initial graphical progress indicator on the display refers to before displaying the initial graphical progress indicator or before changing a visual characteristic of a displayed graphical progress indicator to indicate activation. At least one processor may display all three indicators (e.g., the initial graphical progress indicator, the first additional progress indicator, and the second additional progress) upon receiving the prompt. Such a display may indicate to the user to begin the varying weight routine, e.g., even before the initial graphical progress indicator is activated.

Some disclosed embodiments involve displaying the initial graphical progress indicator, the first additional progress indicator, and the second additional progress indicator successively upon activation. Successively upon activation refers to following each activation. For example, in response to the prompt, at least one processor may display only the initial graphical progress indicator. Following the initial motion stoppage (e.g., indicating that the initial exercise set is complete), the at least one processor may add the first additional progress indicator to the display. Following the first motion stoppage (e.g., indicating that the first additional exercise set is complete), the at least one processor may add the second additional progress indicator to the display.

By way of a non-limiting example, in FIG. 6, at least one processor (e.g., processor 102) may simultaneously display initial graphical progress indicator 606, first additional progress indicator 706, and second additional progress indicator 806. In some embodiments, initial graphical progress indicator 606, first additional progress indicator 706, and second additional progress indicator 806 may be simultaneously displayed in response to receiving the prompt, prior to activation of initial graphical progress indicator on display 234. In some disclosed embodiments, at least on processor may display initial graphical progress indicator 606, first additional progress indicator 706, and second additional progress indicator 806 successively upon activation.

In some disclosed embodiments, the motorized exercise machine includes a cable associated with the motor. A cable in the context of a mechanical portion of an exercise machine refers to an elongated piece of material employed for force resistance purposes. It may resist forces exerted by a weight stack or in the case of an electronic exercise machine, forces exerted by a motor. A cable may be in the form of a rope, chord, filament, band, or bundle. For example, a cable may include a bundle of fibers or wires such as metal (e.g., steel) capable of force resistance. The cable may be sufficiently flexible to permit winding around a spool and/or pulley system. A cable of a weight machine may have a first end connected to a spool and a second end connected to an accessory for maneuvering by a bodily limb and/or appendage (e.g., a hand, foot, arm, leg, shoulder, and/or neck). A cable may be connected to a resistance motor via a pulley system located between the spool and the accessory permitting a user to lift and lower the weights by maneuvering the accessory. In some disclosed embodiments, detecting the initial motion stoppage at the initial resistance level includes determining non-movement of the cable for the initial time threshold, and detecting the first motion stoppage at the first reduced resistance level includes determining non-movement of the cable for the first time threshold. Non-movement of a cable for a time threshold refers to a stationary state for the cable for the time threshold. Non-movement of a cable may indicate that the particular user is not pulling on the cable. At least one processor may receive data from an associated sensor to detect when the cable is in motion (e.g., due to a pulling motion by the particular user) and when the cable is stationary. Upon detection that the cable is stationary (e.g., non-movement of the cable), the at least one processor may time a duration of the non-movement (e.g., the stationary state) to determine if the duration exceeds the initial time threshold (e.g., after completing the plurality of initial resistance level repetitions) or the first time threshold (e.g., after completing the plurality of first reduced resistance level repetitions). For example, at least one processor may determine non-movement of a cable if the cable is determined to move by less than a threshold distance during a threshold time period. For example, if the cable moves by less than 1 millimeter, less than 5 millimeters, or less than 10 millimeters during a 5 second, or 10 second time interval.

By way of a non-limiting example, in FIGS. 2 and 4, motorized resistance exercise machine 200 may include cable 206 associated with motor 230. At least one processor may determine non-movement of the cable (e.g., using mechanical sensor 324 and/or image data capture using mobile communications device 224) for the initial time threshold and/or for the first time threshold to thereby detect the initial motion stoppage at the initial resistance level and/or detect the first motion stoppage at the first reduced resistance level. In some disclosed embodiments, the initial time threshold for the initial resistance level and the first time threshold for the first reduced resistance level are equal (e.g., 2 seconds). In some disclosed embodiments, the initial time threshold for the initial resistance level and the first time threshold for the first reduced resistance level differ (e.g., 3 seconds and 2 seconds, respectively). In some disclosed embodiments, at least one processor may emit audio when the initial time threshold is reached, e.g., by transmitting a signal to a speaker of mobile communications device 224.

Figure 11:
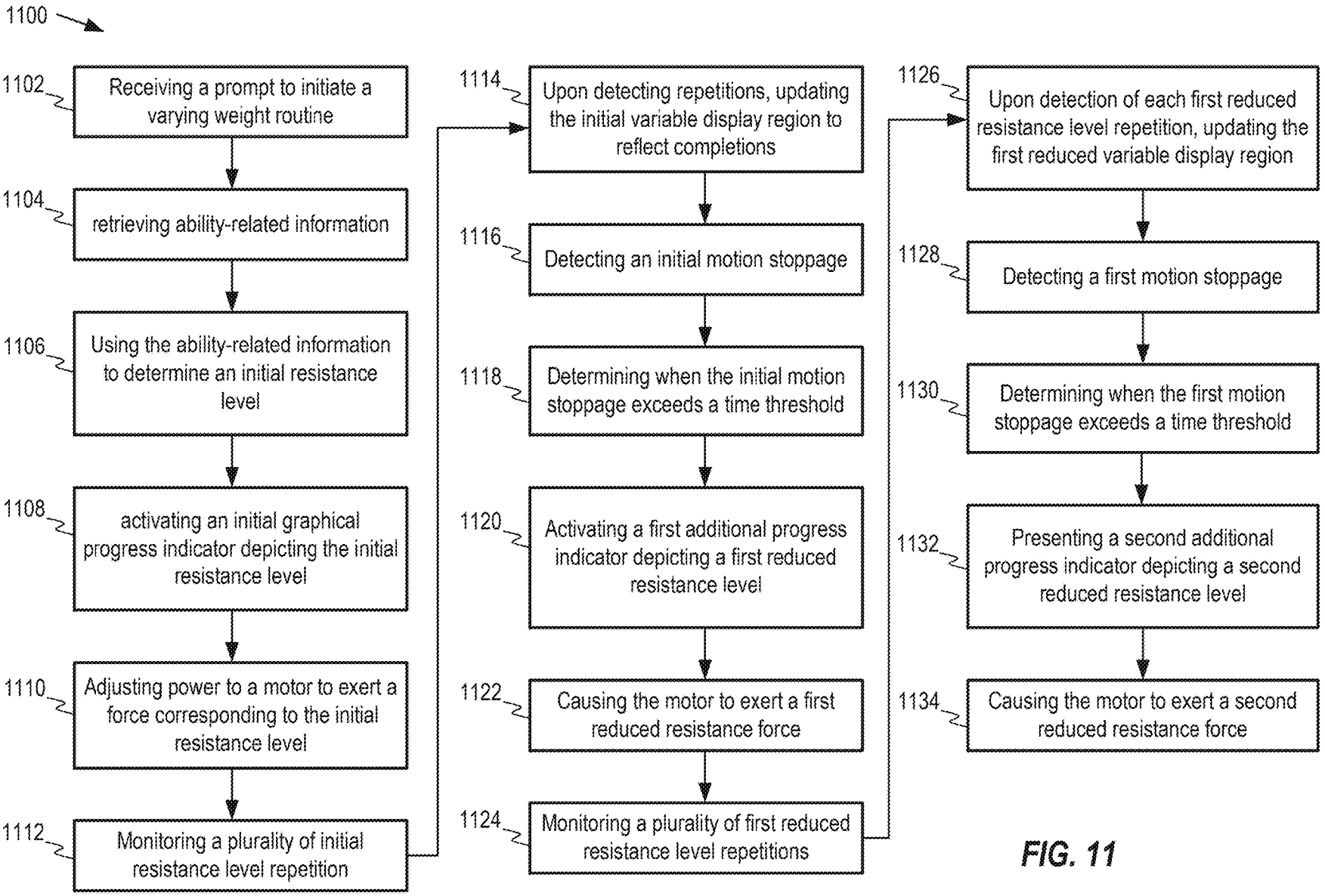
FIG. 11 is a flowchart of an example process for performing electronic exercise machine control operations, consistent with embodiments of the present disclosure.

FIG. 11 is a flowchart of example process 1100 for performing electronic exercise machine control operations, consistent with embodiments of the present disclosure. In some embodiments, process 1100 may be performed by at least one processor (e.g., processor 102 in FIG. 1 of mobile communications device 202 and/or processor 302 of exercise machine 200) to perform operations or functions described herein. In some embodiments, some aspects of process 1100 may be implemented as software (e.g., program codes or instructions) that are stored in a memory (e.g., memory 104) or a non-transitory computer readable medium. In some embodiments, some aspects of process 1100 may be implemented as hardware (e.g., a specific-purpose circuit). In some embodiments, process 1100 may be implemented as a combination of software and hardware.

Process 1100 may include a step 1102 of receiving a prompt to initiate a varying weight routine on a motorized resistance exercise machine for a particular user. By way of a non-limiting example, in FIG. 2, at least one processor (e.g., processor 102) may receive a prompt to initiate a varying weight routine on motorized resistance exercise machine 200 for particular user 232.

Process 1100 may include a step 1104 of retrieving ability-related information about the particular user. By way of a non-limiting example, in FIG. 4, at least one processor (e.g., processor 102 and/or processor 312) may retrieve ability-related information about particular user 232 from cloud service 400 via network 408.

Process 1100 may include a step 1106 of using the ability-related information to determine an initial resistance level for the particular user. By way of a non-limiting example, in FIG. 2, at least one processor may use the ability-related information to determine an initial resistance level for particular user 232.

Process 1100 may include a step 1108 of activating on a display, an initial graphical progress indicator depicting the initial resistance level and including an initial variable display region. By way of a non-limiting example, in FIG. 6, at least one processor may activate on display 234, initial graphical progress indicator 606 depicting the initial resistance level (e.g., corresponding to the height of initial graphical progress indicator 606 on display 234) and including initial variable display region 608.

Process 1100 may include a step 1110 of adjusting power to a motor of the motorized resistance exercise machine to cause the motor to exert an initial resistance force corresponding to the initial resistance level. By way of a non-limiting example, in FIG. 4, at least one processor (e.g., processor 102 and/or processor 312) may adjust power to motor 230 of motorized resistance exercise machine 200 to cause motor 230 to exert an initial resistance force corresponding to the initial resistance level.

Process 1100 may include a step 1112 of, as the particular user exerts forces on the motor countering the initial resistance level, monitoring a plurality of initial resistance level repetition. By way of a non-limiting example, in FIG. 6, at least one processor (e.g., processor (e.g., processor 102 and/or processor 312) may monitoring a plurality of initial resistance level repetitions.

Process 1100 may include a step 1114 of, upon detection of each of the plurality of initial resistance level repetitions, updating the initial variable display region to reflect initial resistance level repetition completions. By way of a non-limiting example, in FIG. 6, upon detection of each of the plurality of initial resistance level repetitions, at least one processor (e.g., processor 102 and/or processor 312) may update initial variable display region 608 to reflect initial resistance level repetition completions (e.g., images 600, 602, and 604).

Process 1100 may include a step 1116 of detecting an initial motion stoppage at the initial resistance level. By way of a non-limiting example, in FIG. 6, at least one processor (e.g., processor 102 and/or processor 312) may detect an initial motion stoppage at the initial resistance level.

Process 1100 may include a step 1118 of determining whether the initial motion stoppage at the initial resistance level exceeds an initial time threshold. By way of a non-limiting example, in FIG. 6, at least one processor may determining whether the initial motion stoppage at the initial resistance level exceeds an initial time threshold.

Process 1100 may include a step 1120 of, when the initial motion stoppage at the initial resistance level exceeds the initial time threshold, activating a first additional progress indicator depicting a first reduced resistance level and including a first reduced variable display region. By way of a non-limiting example, in FIG. 7, when the initial motion stoppage at the initial resistance level exceeds the initial time threshold, at least one processor (e.g., processor 102 and/or processor 312) may activate first additional progress indicator 706 depicting the first reduced resistance level (e.g., corresponding to the height of first additional progress indicator 706 on display 234) and including first reduced variable display region 708.

Process 1100 may include a step 1122 of altering an electrical characteristic applied to the motor to cause the motor to exert a first reduced resistance force less than the initial resistance force. By way of a non-limiting example, in FIG. 4, at least one processor (e.g., processor 102 and/or processor 312) may alter an electrical characteristic applied to motor 230 to cause motor 230 to exert a first reduced resistance force less than the initial resistance force.

Process 1100 may include a step 1124 of, as the particular user exerts forces on the motor countering the first reduced resistance level, monitoring a plurality of first reduced resistance level repetitions. By way of a non-limiting example, in FIG. 7, as particular user 232 exerts forces on motor 230 countering the first reduced resistance level, at least one processor (e.g., processor 102 and/or processor 312) may monitor a plurality of first reduced resistance level repetitions.

Process 1100 may include a step 1126 of upon detection of each of the plurality of first reduced resistance level repetitions, updating the first reduced variable display region to reflect first reduced repetition completions. By way of a non-limiting example, in FIG. 7, upon detection of each of the plurality of first reduced resistance level repetitions, at least one processor (e.g., processor 102 and/or processor 312) may update first reduced variable display region 708 to reflect first reduced repetition completions.

Process 1100 may include a step 1128 of detecting a first motion stoppage at the first reduced resistance level. By way of a non-limiting example, in FIG. 7, at least one processor (e.g., processor 102 and/or processor 312) may detect a first motion stoppage at the first reduced resistance level.

Process 1100 may include a step 1130 of determining whether the first motion stoppage exceeds a first time threshold. By way of a non-limiting example, in FIG. 7, at least one processor (e.g., processor 102 and/or processor 312) may determine whether the first motion stoppage exceeds a first time threshold.

Process 1100 may include a step 1132 of, when the first motion stoppage exceeds the first time threshold, altering the display to present a second additional progress indicator depicting a second reduced resistance level and including a second reduced variable display region. By way of a non-limiting example, in FIG. 8, when the first motion stoppage exceeds the first time threshold, at least one processor (e.g., processor 102 and/or processor 312) may alter display 234 to present second additional progress indicator 806 depicting a second reduced resistance level (e.g., corresponding to the height of second additional progress indicator 806 on display 234) and including a second reduced variable display region 808.

Process 1100 may include a step 1134 of altering the electrical characteristic applied to the motor to cause the motor to exert a second reduced resistance force less than the first reduced resistance force. By way of a non-limiting example, in FIG. 4, at least one processor (e.g., processor 102 and/or processor 312) may alter an electrical characteristic applied to motor 230 to cause motor 230 to exert a second reduced resistance force less than the first reduced resistance force.

What is claimed is:

1. A non-transitory computer readable medium containing instructions that when executed by at least one processor cause the at least one processor to perform electronic exercise machine control operations, comprising:

receiving a prompt to initiate a varying weight routine on a motorized resistance exercise machine for a particular user;

retrieving ability-related information about the particular user;

using the ability-related information to determine an initial resistance level for the particular user;

activating on a display, an initial graphical progress indicator depicting the initial resistance level and including an initial variable display region;

adjusting power to a motor of the motorized resistance exercise machine to cause the motor to exert an initial resistance force corresponding to the initial resistance level;

as the particular user exerts forces on the motor countering the initial resistance level, monitoring a plurality of initial resistance level repetitions;

upon detection of each of the plurality of initial resistance level repetitions, updating the initial variable display region to reflect initial resistance level repetition completions;

detecting an initial motion stoppage during force exertion at the initial resistance level by the particular user;

determining whether the initial motion stoppage at the initial resistance level exceeds an initial time threshold;

when the initial motion stoppage at the initial resistance level exceeds the initial time threshold:

activating a first additional graphical progress indicator depicting a first reduced resistance level and including a first reduced variable display region; and altering an electrical characteristic applied to the motor to cause the motor to exert a first reduced resistance force less than the initial resistance force;

as the particular user exerts forces on the motor countering the first reduced resistance level, monitoring a plurality of first reduced resistance level repetitions;

upon detection of each of the plurality of first reduced resistance level repetitions, updating the first reduced variable display region to reflect first reduced repetition completions;

detecting a first motion stoppage during force exertion at the first reduced resistance level by the particular user;

determining whether the first motion stoppage exceeds a first time threshold; and when the first motion stoppage exceeds the first time threshold:

activating a second additional graphical progress indicator depicting a second reduced resistance level and including a second reduced variable display region; and altering the electrical characteristic applied to the motor to cause the motor to exert a second reduced resistance force less than the first reduced resistance force.

2. The non-transitory computer readable medium of claim 1, wherein retrieving ability-related information about the particular user includes accessing a data repository containing prior workout session data about the particular user.

3. The non-transitory computer readable medium of claim 1, wherein retrieving ability-related information about the particular user includes receiving as real-time input from the particular user, a resistance selection.

4. The non-transitory computer readable medium of claim 1, wherein the initial graphical progress indicator, the first additional graphical progress indicator, and the second additional graphical progress indicator each include an associated progress bar for indicating successive repetitions.

5. The non-transitory computer readable medium of claim 4, wherein the plurality of associated progress bars are arranged as steps.

6. The non-transitory computer readable medium of claim 5, wherein each successive step is presented at an elevation lower than a prior step, thereby visually presenting the initial resistance level, the first reduced resistance level, and the second reduced resistance level.

7. The non-transitory computer readable medium of claim 1, wherein the initial graphical progress indicator, the first additional graphical progress indicator, and the second additional graphical progress indicator each include an accumulative region populated in response to detection of successive repetitions.

8. The non-transitory computer readable medium of claim 7, wherein each of the accumulative regions are sized to correspond to a predetermined number of repetitions, and wherein after the predetermined number of repetitions are detected the operations further include presenting on the display an overage indicator.

9. The non-transitory computer readable medium of claim 8, wherein during successive repetitions following display of the overage indicator, an associated accumulative region remains unchanged.

10. The non-transitory computer readable medium of claim 1, wherein the display of the initial graphical progress indicator, the first additional graphical progress indicator, and the second additional graphical progress indicator are caused to be presented on a mobile communications device paired to the motorized resistance exercise machine.

11. The non-transitory computer readable medium of claim 1, wherein the operations further comprise simultaneously displaying the initial graphical progress indicator, the first additional progress indicator, and the second additional progress indicator.

12. The non-transitory computer readable medium of claim 1, wherein the initial graphical progress indicator, the first additional progress indicator, and the second additional progress indicator are simultaneously displayed in response to receiving the prompt, prior to activation of the initial graphical progress indicator on the display.

13. The non-transitory computer readable medium of claim 1, wherein the operations further comprise displaying the initial graphical progress indicator, the first additional progress indicator, and the second additional progress indicator successively upon activation.

14. The non-transitory computer readable medium of claim 1, wherein adjusting power to the motor includes altering at least one of a current or a voltage.

15. The non-transitory computer readable medium of claim 1, wherein the operations further comprise using the ability-related information to determine the first reduced resistance level and the second reduced resistance level.

16. The non-transitory computer readable medium of claim 1, wherein the motorized exercise machine includes a cable associated with the motor, and wherein detecting the initial motion stoppage at the initial resistance level includes determining non-movement of the cable for the initial time threshold, and wherein detecting the first motion stoppage at the first reduced resistance level includes determining non-movement of the cable for the first time threshold.

17. The non-transitory computer readable medium of claim 1, wherein the initial time threshold for the initial resistance level and the first time threshold for the first reduced resistance level are equal.

18. The non-transitory computer readable medium of claim 1, wherein the initial time threshold for the initial resistance level and the first time threshold for the first reduced resistance level differ.

19. The non-transitory computer readable medium of claim 1, wherein the operations further comprise emitting audio when the initial time threshold is reached.

20. A method for performing electronic exercise machine control operations, the method comprising:

receiving a prompt to initiate a varying weight routine on a motorized resistance exercise machine for a particular user;

retrieving ability-related information about the particular user;

using the ability-related information to determine an initial resistance level for the particular user;

activating on a display, an initial graphical progress indicator depicting the initial resistance level and including an initial variable display region;

adjusting power to a motor of the motorized resistance exercise machine to cause the motor to exert an initial resistance force corresponding to the initial resistance level;

as the particular user exerts forces on the motor countering the initial resistance level, monitoring a plurality of initial resistance level repetitions;

upon detection of each of the plurality of initial resistance level repetitions, updating the initial variable display region to reflect initial resistance level repetition completions;

detecting an initial motion stoppage at the initial resistance level;

determining whether the initial motion stoppage at the initial resistance level exceeds an initial time threshold;

when the initial motion stoppage at the initial resistance level exceeds the initial time threshold:

activating a first additional progress indicator depicting a first reduced resistance level and including a first reduced variable display region; and altering an electrical characteristic applied to the motor to cause the motor to exert a first reduced resistance force less than the initial resistance force;

as the particular user exerts forces on the motor countering the first reduced resistance level, monitoring a plurality of first reduced resistance level repetitions;

upon detection of each of the plurality of first reduced resistance level repetitions, updating the first reduced variable display region to reflect first reduced repetition completions;

detecting a first motion stoppage at the first reduced resistance level;

determining whether the first motion stoppage exceeds a first time threshold; and when the first motion stoppage exceeds the first time threshold:

altering the display to present a second additional progress indicator depicting a second reduced resistance level and including a second reduced variable display region; and altering the electrical characteristic applied to the motor to cause the motor to exert a second reduced resistance force less than the first reduced resistance force.

21. A system for performing electronic exercise machine control operations, comprising at least one processor configured to:

receive a prompt to initiate a varying weight routine on a motorized resistance exercise machine for a particular user;

retrieve ability-related information about the particular user;

use the ability-related information to determine an initial resistance level for the particular user;

activate on a display, an initial graphical progress indicator depicting the initial resistance level and including an initial variable display region;

adjust power to a motor of the motorized resistance exercise machine to cause the motor to exert an initial resistance force corresponding to the initial resistance level;

as the particular user exerts forces on the motor countering the initial resistance level, monitor a plurality of initial resistance level repetitions;

upon detection of each of the plurality of initial resistance level repetitions, update the initial variable display region to reflect initial resistance level repetition completions;

detect an initial motion stoppage at the initial resistance level;

determine whether the initial motion stoppage at the initial resistance level exceeds an initial time threshold;

when the initial motion stoppage at the initial resistance level exceeds the initial time threshold:

activate a first additional progress indicator depicting a first reduced resistance level and including a first reduced variable display region; and alter an electrical characteristic applied to the motor to cause the motor to exert a first reduced resistance force less than the initial resistance force;

as the particular user exerts forces on the motor countering the first reduced resistance level, monitor a plurality of first reduced resistance level repetitions;

upon detection of each of the plurality of first reduced resistance level repetitions, update the first reduced variable display region to reflect first reduced repetition completions;

detect a first motion stoppage at the first reduced resistance level;

determine whether the first motion stoppage exceeds a first time threshold; and when the first motion stoppage exceeds the first time threshold:

alter the display to present a second additional progress indicator depicting a second reduced resistance level and including a second reduced variable display region; and alter the electrical characteristic applied to the motor to cause the motor to exert a second reduced resistance force less than the first reduced resistance force.

22. A system for performing electronic exercise machine control operations, comprising:

an electronic exercise machine;

a resistance motor mounted on the electronic exercise machine;

a display associated with the electronic exercise machine;

at least one processor associated with the electronic exercise machine, the at least one processor configured to:

receive a prompt to initiate a varying weight routine on a motorized resistance exercise machine for a particular user;

retrieve ability-related information about the particular user;

use the ability-related information to determine an initial resistance level for the particular user;

activate on the display, an initial graphical progress indicator depicting the initial resistance level and including an initial variable display region;

adjust power to the resistance motor of the electronic exercise machine to cause the motor to exert an initial resistance force corresponding to the initial resistance level;

as the particular user exerts forces on the motor countering the initial resistance level, monitor a plurality of initial resistance level repetitions;

upon detection of each of the plurality of initial resistance level repetitions, update the initial variable display region to reflect initial resistance level repetition completions;

detect an initial motion stoppage at the initial resistance level;

determine whether the initial motion stoppage at the initial resistance level exceeds an initial time threshold;

when the initial motion stoppage at the initial resistance level exceeds the initial time threshold:

activate a first additional progress indicator depicting a first reduced resistance level and including a first reduced variable display region; and alter an electrical characteristic applied to the motor to cause the motor to exert a first reduced resistance force less than the initial resistance force;

as the particular user exerts forces on the motor countering the first reduced resistance level, monitor a plurality of first reduced resistance level repetitions;

upon detection of each of the plurality of first reduced resistance level repetitions, update the first reduced variable display region to reflect first reduced repetition completions;

detect a first motion stoppage at the first reduced resistance level;

determine whether the first motion stoppage exceeds a first time threshold; and when the first motion stoppage exceeds the first time threshold:

alter the display to present a second additional progress indicator depicting a second reduced resistance level and including a second reduced variable display region; and alter the electrical characteristic applied to the motor to cause the motor to exert a second reduced resistance force less than the first reduced resistance force.

* * * * *